US009815297B2

(12) United States Patent
Uno et al.

(10) Patent No.: US 9,815,297 B2
(45) Date of Patent: Nov. 14, 2017

(54) PRINTING DEVICE, CONTROL METHOD, AND PRINTING SYSTEM

(71) Applicant: Seiko Epson Corporation, Tokyo (JP)

(72) Inventors: Akihiro Uno, Matsumoto (JP); Shinichi Yoshie, Tatsuno-machi (JP); Hideki Nishimura, Matsumoto (JP); Katsuo Takeuchi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/367,565

(22) Filed: Dec. 2, 2016

(65) Prior Publication Data

US 2017/0157948 A1 Jun. 8, 2017

(30) Foreign Application Priority Data

Dec. 4, 2015 (JP) ..... 2015-237800
Jan. 14, 2016 (JP) ..... 2016-005087
(Continued)

(51) Int. Cl.
*B41J 2/355* (2006.01)
*B41J 2/165* (2006.01)
*B41J 29/393* (2006.01)

(52) U.S. Cl.
CPC ..... *B41J 2/355* (2013.01); *B41J 2/16579* (2013.01); *B41J 2/3558* (2013.01); *B41J 29/393* (2013.01)

(58) Field of Classification Search
CPC . B41J 2/16579; B41J 2/32; B41J 2/335; B41J 2/3352; B41J 2/35; B41J 2/355; B41J 2/3558; B41J 29/393
See application file for complete search history.

(56) References Cited

U.S. PATENT DOCUMENTS 4,453,166 A 6/1984 Enoto
5,434,602 A * 7/1995 Kaburagi ..... B41J 19/207 318/653
(Continued)

FOREIGN PATENT DOCUMENTS

JP 10-166637 A 6/1998
JP 2000-141730 A 5/2000
JP 2011-148232 A 8/2011

*Primary Examiner* — Anh T. N. Vo
(74) *Attorney, Agent, or Firm* — Nutter McClennen & Fish LLP; John J. Penny, Jr.

(57) ABSTRACT

A thermal printer with head elements enables accurately determining the state of deterioration of the head elements, and minimizing the amount of stored data. A printing device has a thermal head having multiple head elements; a voltage application circuit configured to apply a printing voltage and an inspection voltage to the head elements; a head controller configured to control the thermal head and the voltage application circuit; and data storage configured to store a conversion table relationally storing a divided voltage and a resistance of the head elements. At a specific timing, the head controller applies the inspection voltage to the head elements by the voltage application circuit, measures the divided voltage of the head elements, converts the measured divided voltage to resistance based on the conversion table, acquires deterioration information based on the converted resistance, and stores the deterioration information in the data storage.

19 Claims, 17 Drawing Sheets

(30) Foreign Application Priority Data

Feb. 25, 2016 (JP) ..... 2016-034289
Feb. 25, 2016 (JP) ..... 2016-034500

(56) References Cited

U.S. PATENT DOCUMENTS 5,988,793 A * 11/1999 Hattori ..... B41J 2/4155
347/55
8,147,028 B2 * 4/2012 Ito ..... B41J 2/16579
347/19
8,654,161 B2 2/2014 Imaizumi

* cited by examiner

CONVERSION TABLE CT

| AD VALUE | RESISTANCE (Ω) |
|---|---|
| ⋮ | ⋮ |
| ⋮ | ⋮ |
| ⋮ | ⋮ |
| 177 | 579 |
| 178 | 589 |
| 179 | 601 |
| 180 | 612 |
| 181 | 624 |
| 182 | 636 |
| 183 | 648 |
| 184 | 661 |
| 185 | 674 |
| 186 | 687 |
| 187 | 701 |
| ⋮ | ⋮ |
| ⋮ | ⋮ |
| ⋮ | ⋮ |

FIG. 4

DETERIORATION INFORMATION

| HEAD ELEMENT No. | RATE OF RESISTANCE CHANGE | ALARM FLAG |
|---|---|---|
| 1 | 3% | OFF |
| 2 | 5% | OFF |
| ⋮ | ⋮ | ⋮ |
| 50 | 16% | ON(A) |
| ⋮ | ⋮ | ⋮ |
| 60 | -10% | OFF |
| 61 | -18% | ON(A) |
| ⋮ | ⋮ | ⋮ |
| 150 | 33% | ON(B) |
| ⋮ | ⋮ | ⋮ |
| 250 | -31% | ON(B) |
| ⋮ | ⋮ | ⋮ |
| 512 | -5% | OFF |

FIG. 8

PRINTING DEVICE, CONTROL METHOD, AND PRINTING SYSTEM

CROSS-REFERENCE TO RELATED APPLICATIONS

This application claims priority under 35 U.S.C. §119 to Japanese Patent Application Nos. 2016-005087 filed on Jan. 14, 2016, 2015-237800 filed on Dec. 4, 2015, 2016-034500 filed on Feb. 25, 2016 and 2016-034289 filed on Feb. 25, 2016, respectively, the entire disclosure of which is expressly incorporated by reference herein.

BACKGROUND

1. Technical Field

The present invention relates to a thermal printing device having a head element, and relates more particularly to a printing device capable of accurately determining the state of deterioration of the head element while suppressing the amount of stored data.

The present invention also relates to a thermal printing device having a head element, and relates more particularly to a printing device capable of surveying the state of deterioration of the head elements in stages without interfering with the printing process, and suppressing the size of the circuitry.

The invention also relates to a printing device that detects deterioration of the printhead, and more particularly is capable of shortening the detection time while suppressing detection errors.

2. Related Art

Thermal printers are commonly used for printing sales receipts, for example. Such thermal printers have multiple head elements in the printhead, and print by applying voltage to the head elements and causing the resistive elements (heat elements) of the head elements to produce heat. If some of the head elements deteriorate, the print quality of such printers drops undesirably.

JP-A-2000-141730 teaches a method of detecting problems in the thermal head, and makes a good/no-good decision about the printhead based on the maximum and minimum resistance of the heat elements.

JP-A-H10-166637 discloses a method of detecting deterioration of the head elements while printing as an example of technology that increases the speed of detection.

JP-A-2011-148232 discloses a mechanism for checking operation of the head elements, capable of detecting defective (problem) elements in the thermal head of a thermal printer without applying heat to the head elements.

However, the method described in JP-A-2000-141730 detects whether head elements are good or no-good, and cannot assess change (advancement) in the deterioration of head elements.

Avoiding printing problems such as streaking of barcodes printed on receipts is essential in receipt printers used in retail stores, for example, and replacing head elements at an appropriate time before the head elements fail is desirable. More specifically, technology enabling more precisely managing deterioration of head elements is desirable.

It is also desirable to suppress the amount of data the printer must store in order to evaluate deterioration of the head elements.

Depending on the method used, checking for deterioration of the head elements of receipt printers used at the checkout counter in food service businesses and convenience stores that are open 24 hours a day may require stopping printing receipts, and this may interfere with business operations.

To address this problem, JP-A-H10-166637 teaches a method of providing a current detection resistor to every signal line and inspecting the head elements while printing receipts, but this method requires large-scale circuitry, resulting in a high cost.

Because the voltage application circuit described in JP-A-2011-148232 uses diodes as a reverse current protection circuit of the deterioration detection circuit, variation in the forward voltage can result in detection errors.

A FET (field effect transistor) may conceivably be used in the reverse current protection circuit to overcome this problem. However, if a smoothing capacitor is provided in the path of the printing current to suppress noise in such a voltage application circuit, the charge that is left from deterioration detection must be discharged, and such discharge is time-consuming.

There is also a danger with such voltage application circuits that the printing voltage may be applied to the small-signal control circuit unit of the detection circuit, and the small-signal control circuit may be destroyed by the application of such an over-voltage.

An objective of at least one embodiment of the invention is to provide a thermal printing device with head elements where the printing device is capable of accurately determining the state of deterioration of the head elements, and minimizing the amount of stored data.

Another objective of at least one embodiment of the invention is to provide a thermal printing device with head elements where the printing device is capable of surveying the state of deterioration of the head elements in stages without interfering with the printing process, and suppressing the size of the circuitry.

The invention also relates to a printing device that detects deterioration of the printhead, and more particularly is capable of shortening the detection time while suppressing detection errors.

Another objective of the invention is to provide a printing device that can reliably prevent damage to the detection circuit resulting from application of an over-voltage.

SUMMARY

A printing device according to at least one embodiment of the invention has a thermal head having multiple head elements; a voltage application circuit configured to apply a printing voltage and an inspection voltage to the head elements; a head controller configured to control the thermal head and the voltage application circuit; and data storage configured to store a conversion table relationally storing a divided voltage and a resistance of the head elements; the head controller, at a specific timing, applying the inspection voltage to the head elements by the voltage application circuit, measuring the divided voltage of the head elements, converting the measured divided voltage to resistance based on the conversion table, acquiring deterioration information based on the converted resistance, and storing the deterioration information in the data storage.

This aspect of the invention enables determining the state of deterioration of head elements from the resistance of the head elements at an appropriate time, and can minimize the amount of data stored by the printing device because the printing device only needs to store a conversion table.

In another aspect of at least one embodiment of the invention, the data storage stores the initial value of the divided voltage or resistance of the head elements; and the head controller acquires the deterioration information based on the initial value.

This configuration uses the initial value of the head elements to evaluate deterioration, and can determine deterioration accurately.

Further preferably, the deterioration information includes the rate of change in the resistance of the head elements.

This configuration can evaluate deterioration accurately.

In another aspect of at least one embodiment of the invention, the divided voltage is expressed by data of four bytes or less.

This configuration can minimize the amount of data stored in the printer.

Another aspect of at least one embodiment of the invention is a control method of a printing device having a thermal head with multiple head elements, a voltage application circuit configured to apply a printing voltage and an inspection voltage to the head elements, and data storage configured to store a conversion table relationally storing a divided voltage and a resistance of the head elements. The control method includes: at a specific timing, applying the inspection voltage to the head elements by the voltage application circuit, measuring the divided voltage of the head elements, converting the measured divided voltage to resistance based on the conversion table, acquiring deterioration information based on the converted resistance, and storing the deterioration information in the data storage.

Another aspect of at least one embodiment of the invention is a printing system including a control device and a printing device. The printing device includes a thermal head having multiple head elements; a voltage application circuit configured to apply a printing voltage and an inspection voltage to the head elements; data storage configured to store a conversion table relationally storing a divided voltage and a resistance of the head elements; and a head controller. The head controller is configured to, at a specific timing, apply the inspection voltage to the head elements by the voltage application circuit, measure the divided voltage of the head elements, convert the measured divided voltage to resistance based on the conversion table, acquire deterioration information based on the converted resistance, store the deterioration information in the data storage, and send the divided voltage of the head elements and/or deterioration information to the control device.

This aspect of the invention simplifies managing deterioration of a printing device on an external device.

Further preferably, the specific timing is when a state in which printing is not possible is detected.

This configuration uses a time in which printing is not possible to inspect the head elements, and can therefore evaluate deterioration of the head elements without interfering with the printing process. Furthermore, because head element inspection runs parallel to the printing process, increase in the size of the circuitry can be suppressed.

In a printing device according to another aspect of at least one embodiment of the invention, the process of measuring the divided voltage of the head elements is applied to a specific number of head elements, the specific number being a number of head elements that can all be tested while printing is not possible.

This configuration can reliably not interfere with the printing process because the deterioration evaluation process is applied to a number of head elements that can all be inspected during a time in which printing is not possible, such as when cutting the print medium, instead of applying the deterioration evaluation process to all head elements in a single continuous process.

Further preferably, the head controller determines the state of deterioration of the head elements using a plurality of threshold values previously set for the divided voltages.

This configuration evaluates the degree of deterioration (deterioration state) using multiple threshold values, and can therefore determine deterioration with greater precision.

Further preferably, the control device sends a command to the printing device; and the printing device receives the command and sends deterioration information to the control device.

The control device in this configuration can process deterioration information of the head elements by a command from a remote device, and diversify management of the deterioration information.

Another aspect of at least one embodiment of the invention is a printing device including: a printhead having multiple head elements; a voltage application circuit configured to apply a printing voltage and an inspection voltage to the head elements; and a head controller configured to control the printhead and the voltage application circuit; the voltage application circuit including a capacitor between a printing voltage control FET and the head elements, and a reverse current prevention FET between the inspection power supply and the head elements; the head controller, when changing the printing voltage to the inspection voltage, energizes all head elements after stopping the printing voltage, and applies the inspection voltage after energizing the head elements.

Because the voltage application circuit in this configuration has a capacitor and reverse current protection FET, printing and the head elements can be accurately inspected, residual charge in the capacitor can be discharged in a short time by energizing all head elements, and the time required to inspect the head elements (detect deterioration) can be shortened.

Further preferably, the head controller applies the inspection voltage after waiting a specific time after energizing all head elements.

This configuration can inspect the head elements (detect deterioration) with no problem because discharging continues for an appropriate time.

Further preferably, the specific time is the time during which the residual charge of the capacitor is discharged.

This configuration can safely inspect the head elements (detect deterioration) after sufficiently lowering the voltage of the capacitor.

Another aspect of at least one embodiment of the invention is a control method of a printing device having a printhead with multiple head elements, and a voltage application circuit configured to apply a printing voltage and an inspection voltage to the head elements; the voltage application circuit including a capacitor between a printing voltage control FET and the head elements, and a reverse current prevention FET between the inspection power supply and the head elements; and the control method comprising energizing all head elements after stopping the printing voltage, and applying the inspection voltage after energizing the head elements, when changing the printing voltage to the inspection voltage.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 shows an example of a conversion table CT.

FIG. 8 shows an example of deterioration information.

DESCRIPTION OF EMBODIMENTS

Figure 1:
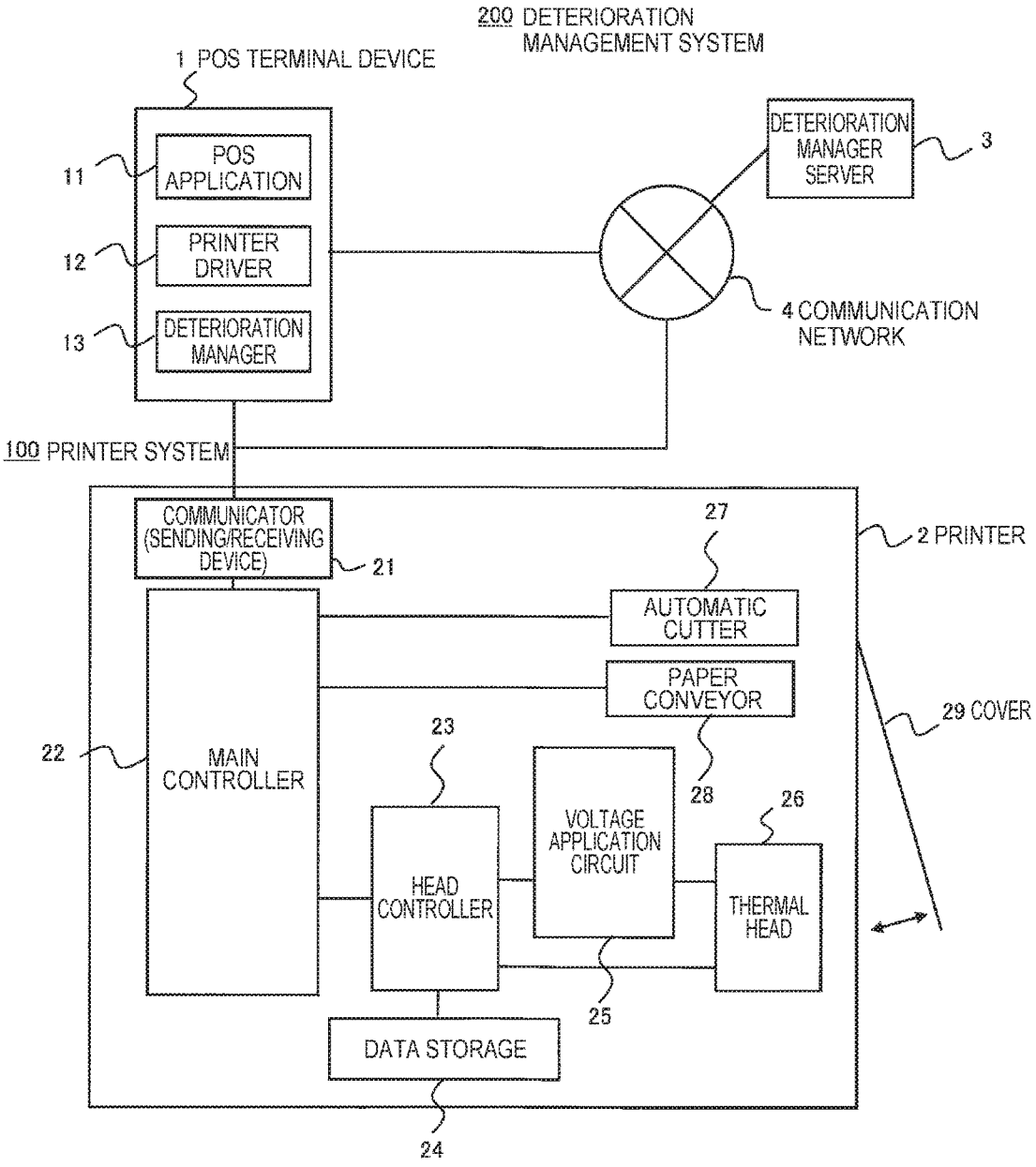
FIG. 1 schematically illustrates the configuration of a printing device according to a preferred embodiment of the invention.

An embodiment of the present invention is described below with reference to the accompanying figures. However, the embodiment described below does not limit the technical scope of the invention. Note that in the figures like or similar parts are identified by the same reference numerals or reference symbols.

FIG. 1 illustrates the configuration of a printing device according to an embodiment of the invention. The printer 2 shown in FIG. 1 is a printing device according to one embodiment of the invention. The first time the printer 2 turns on, the printer 2 measures and stores as the initial value the divided voltage (A/D) of each head element (RH-1 to RH-n) in the thermal head 26 of the printer 2; then at a specific timing measures and acquires as the state value the divided voltage (A/D) of each head element; then converts, for each head element, the state value and stored initial value to a head element resistance value based on a conversion table CT; and then evaluates the deterioration of the head elements based on the converted resistance values.

As a result, the state of deterioration of each head element can be appropriately determined, and head elements can be replaced before the head elements fail and print quality drops. The printer 2 also stores the conversion table CT used to convert the divided voltages to resistance values, and can suppress the amount of data that must be stored in the printer to evaluate head element deterioration.

As shown in FIG. 1, the printer 2 in this embodiment of the invention is a printing device for printing receipts based on print commands from a POS (point-of-sale) terminal device 1 (control device). The POS terminal device 1 and printer 2 are both configured to communicate with a deterioration manager server 3 (control device) through the Internet or other communication network 4. A printer system 100 (printing system) can be configured from the POS terminal device 1 and printer 2, and a deterioration management system 200 (printing system) can be configured from the POS terminal device 1, printer 2, and deterioration manager server 3, or from the printer 2 and deterioration manager server 3.

Note that while not shown in the figures, multiple printer systems 100 and POS servers, for example, may be connected to the communication network 4.

The POS terminal device 1 is a register used in a retail business, for example, and is a host device that sends print commands for the printer 2 to print receipts, for example. While not shown in the figures, the POS terminal device 1 includes a CPU, RAM, ROM, display device, input devices (such as a barcode reader), and communication device, and executes a payment process at the point of sale. As described below, the POS terminal device 1 may also manage deterioration of the head elements (RH-1 to RH-n) of the printer 2.

As shown in FIG. 1, the functional configuration of the POS terminal device 1 includes a POS application 11, printer driver 12, and deterioration manager 13.

The POS application 11 handles such tasks as processing payments at the point of sale, issuing receipt and coupon print requests, and sending data to a POS server not shown. When requesting printing, the POS application 11 outputs print request data to the printer driver 12.

The printer driver 12 handles driver functions for the receipt printer 2. The printer driver 12 receives print request data output from the POS application 11, and generates print data expressed by commands for the printer 2 according to the print request data, and sends the print data to the printer 2.

The deterioration manager 13 handles managing deterioration of the head elements (RH-1 to RH-n) of the printer 2. The specific function of the deterioration manager 13 is described below.

Note that the POS application 11, printer driver 12, and deterioration manager 13 are each embodied by a program defining process content, a CPU that runs the program, and RAM, for example.

The deterioration manager server 3 is a server for managing information related to deterioration of a managed printer such as printer 2. While not shown in the figures, the deterioration manager server 3 is a server computer, and comprises a CPU, RAM, ROM, hard disk drive, display device, input device, and communication device. The specific function of the deterioration manager server 3 is described further below.

The printer 2 is a thermal printer having a line head, and prints receipts and coupons, for example, according to commands from the POS terminal device 1 (according to the print data). The printer 2 prints the print objects on the print medium (such as roll paper), cuts the paper with a cutter when printing is completed, and discharges the printed object.

The printer 2 is a type of intelligent printer, and, in addition to a controller for controlling printing as in a common printer, has a data processing device (computing device) similar to a personal computer.

The functional configuration of the printer 2 is shown in FIG. 1 and described below. The communicator 21 is a communication device for communicating with external devices, and handles communication with the POS terminal device 1 and deterioration manager server 3, for example.

The main controller 22 is the main control unit of the printer 2, and handles control functions other than those handled by the head controller 23 described below. The main controller 22 is configured with a data processing device (computing device) like the personal computer noted above.

The head controller 23 controls the thermal head 26 and voltage application circuit 25 to print on print media, and executes the process of evaluating the state of deterioration of the head elements (RH-1 to RH-n) in the thermal head 26. The head controller 23 is configured by CPU, RAM, ROM, ASIC, for example, and executes processes by the CPU reading and running a program stored in ROM. The specific process executed by the head controller 23 is described further below.

The data storage 24 stores data related to the process whereby the head controller 23 evaluates the state of deterioration of the head elements (RH-1 to RH-n). More specifically, the data storage 24 stores data including the conversion table CT, the initial value (divided voltage value, A/D) of each head element, and deterioration information (head element identification number (head element No.), and the degree of deterioration of each head element (rate of change in resistance)). Note that the data storage 24 may be configured using NVRAM.

The voltage application circuit 25 is the circuit that applies voltage to the thermal head 26. The voltage application circuit 25 has two power supplies of different voltages (24 V, 3.3 V), applies the printing voltage (24 V) to the thermal head 26 when printing, and applies the inspection voltage (3.3 V) when inspecting the head elements (RH-1 to RH-n).

The thermal head 26 has multiple head elements (RH-1 to RH-n) and a selection unit for selecting the head elements. When printing, the printing voltage is applied to the head elements (RH-1 to RH-n) selected by the selection unit, causing the heat elements (resistive elements) of those head elements to emit heat and print on the print medium. During inspection (when evaluating deterioration) of the head elements (RH-1 to RH-n), the inspection voltage is applied to the head elements (RH-1 to RH-n) selected by the selection unit.

The automatic cutter 27 comprises a blade and a driver, and when printing a receipt ends, cuts the print medium as controlled by the main controller 22.

The paper conveyor 28 comprises a conveyance roller and driver. As controlled by the main controller 22, the paper conveyor 28 conveys the print medium from the print medium storage unit to the position of the head elements, and when printing ends, conveys the print medium to the position of the automatic cutter 27.

The cover 29 is disposed on the case of the printing device, and enables opening of the print medium storage unit. When the cover 29 is opened by the operator to install the print medium, for example, the main controller 22 detects that the cover 29 opened.

Figure 2:
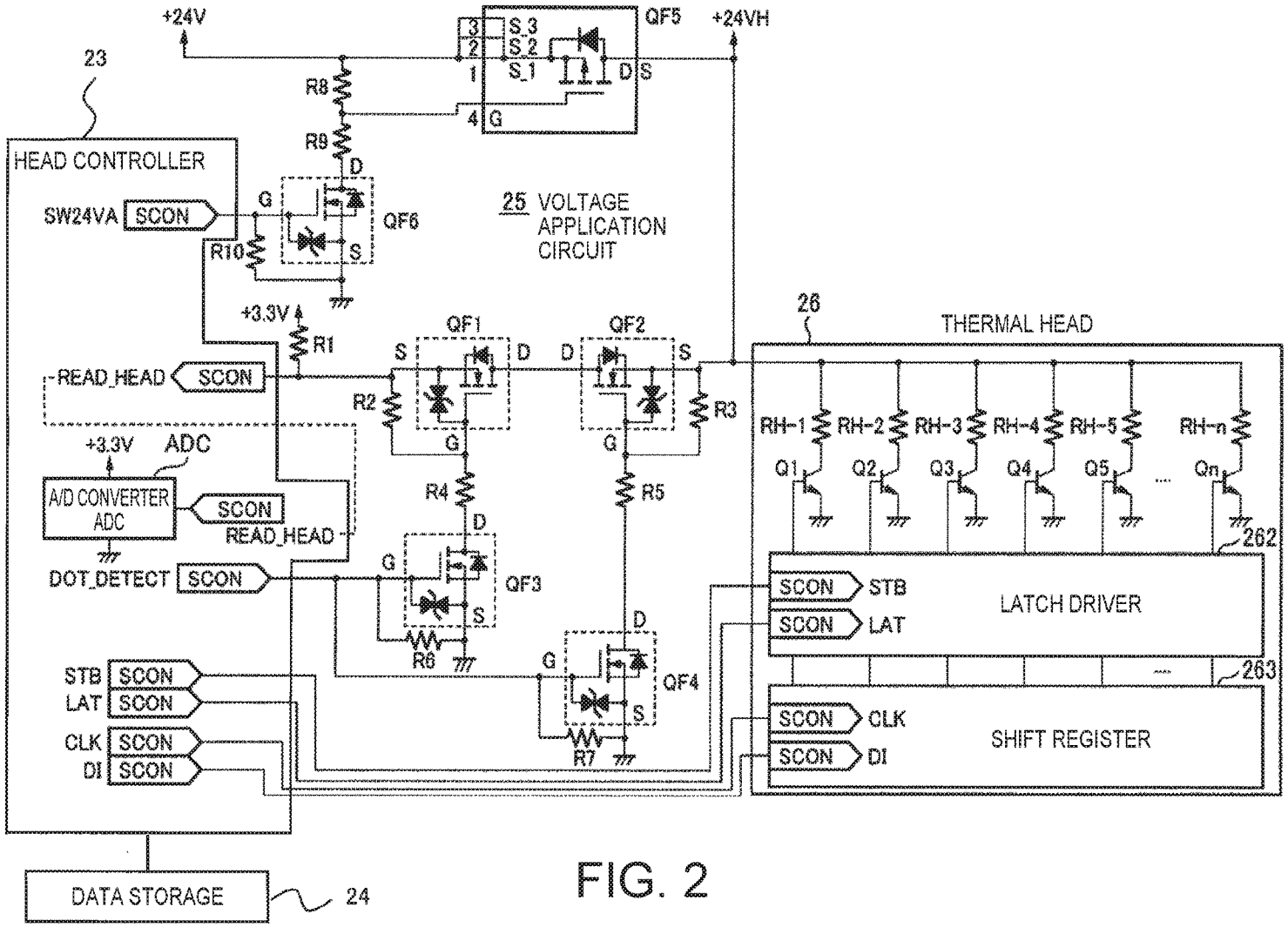
FIG. 2 is a circuit diagram showing an example of the voltage application circuit 25 and thermal head 26.

FIG. 2 is a circuit diagram showing an example of the voltage application circuit 25 and thermal head 26. As shown in FIG. 2, the thermal head 26 comprises the multiple head elements (RH-1 to RH-n) of the line head, a latch driver 262, and a shift register 263 of n flip-flops. The selection unit described above comprises the latch driver 262 and shift register 263. As shown in FIG. 2, the head elements (RH-1 to RH-n) have resistive elements as the heat elements.

The shift register 263 is normally configured from multiple semiconductor devices connected in series such that, for example, the DO (Data Out) pin of the first shift register is connected to the DI (Data In) pin of the second shift register.

The latch driver 262 has a strobe signal input STB, and a latch signal input LAT. Each of the n shift registers also has an input pin DI to which serial data (print data in this embodiment) is input, a clock signal input pin CLK, and an output pin DO from which serial data overflow from the shift register 263 is output.

One line of serial data is input one bit at a time timed to the clock signal from the input pin DI of the first shift register in response to a control signal from the head controller 23 connected to these circuits on the left side in FIG. 2. Next, once the one line of serial data is stored in the shift register, one line of serial data is stored by the latch signal in the latch driver 5 as parallel data.

When a strobe signal is received, the latch driver 262 energizes the head elements identified by a latch value of 1 while the strobe signal is being received. One line (one dot) of the image is formed on the print medium by the energized head elements, and the paper is then advanced the distance of one dot by a paper feed mechanism not shown. A document is printed by repeating these steps.

The voltage application circuit 25 controls the on/off state of the 24-V printing power supply and the 3.3-V inspection power supply of the head elements based a switching signal (SW24VA or DOT_DETECT). The inspection voltage is preferably the same voltage as the power supply of the head controller 23, and in this example is 3.3 V. This reduces variance during A/D conversion.

When printing, the SW24VA signal from the head controller 23 turns switch QF5, which is a FET, on, and applies the 24-V printing voltage to the head elements (RH-1 to RH-n).

During inspection of the head elements (RH-1 to RH-n) (when determining deterioration), switch QF5 is off; and the DOT_DETECT signal from the head controller 23 turns switches QF1 and QF2, which are also FETs, on, and applies the 3.3-V inspection voltage to the head elements (RH-1 to RH-n).

Next, the head controller 23 specifies (selects) by the DI signal the head elements (RH-1 to RH-n) to inspect, and those head elements (RH-1 to RH-n) are energized by the latch driver 262.

As a result, a series circuit connecting the inspection resistor R1 and the resistive elements (heat elements) of the head elements is formed, and the head controller 23, by the READ_HEAD signal, acquires (measures) the divided voltage between the inspection resistor R1 of the series circuit and the resistive element (heat elements) of the head element. More specifically, an A/D-converted value A/D is acquired through the A/D converter ADC. Note that while something may be printed if energized for a long time, usually nothing is printed by applying the inspection voltage to the head elements.

A printer 2 thus comprised is characterized by the process for evaluating deterioration of the head elements (RH-1 to RH-n), and the content of this process is described below.

The conversion table CT used to convert the divided voltage (A/D) to resistance (Ω) is described next. The conversion table CT is created before the printer 2 is shipped, and is stored in the data storage 24 of the printer 2.

In the series circuit that connects the inspection resistor R1 described above to the resistive elements (heat elements) of the head elements, which is formed when inspecting the head elements (RH-1 to RH-n) (when determining deterioration), the following equation (1) is true where R is the resistance (Ω) of the inspection resistor R1, and Rhead is the resistance (Ω) of the resistive element of the head element.

$$Rhead=(R\times AD)/(255-AD) \quad (1)$$

Note that AD is the divided voltage (A/D) acquired through the A/D converter ADC with the READ_HEAD signal in FIG. 2, and is expressed by a 1-byte data value from 0-255 (equivalent to 0-3.3 V), for example. Note that the divided voltage (A/D) value is preferably no more than 4 bytes long.

Figure 3:
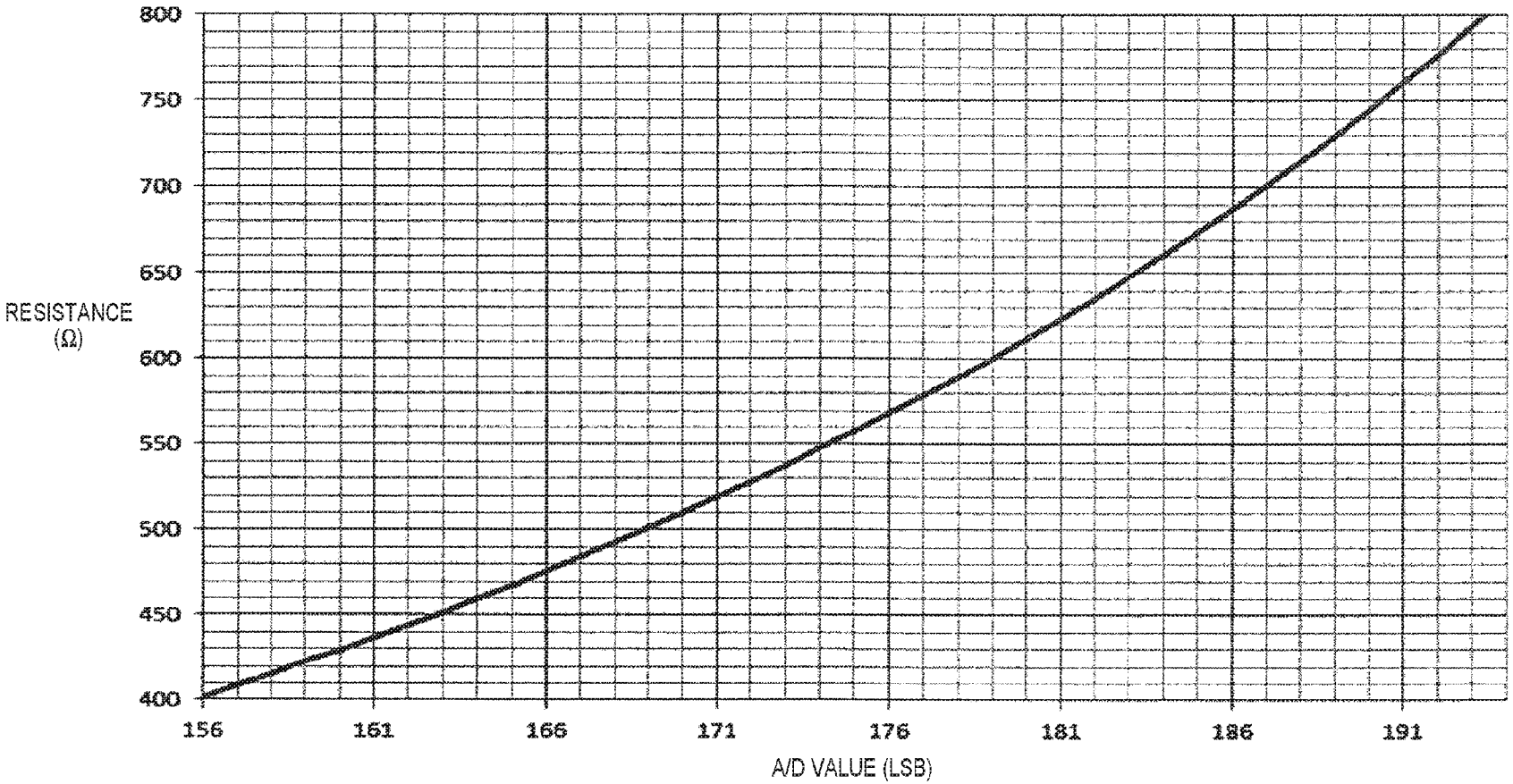
FIG. 3 is a graph of the relationship between the divided voltage (A/D) and resistance (Rhead).

FIG. 3 is a graph of the relationship between the divided voltage (A/D) and resistance (Rhead). The graph in FIG. 3 shows the results obtained from equation (1) when the resistance R of the inspection resistor R1 was 255Ω. This graph can be used to convert the measured (acquired) divided voltage (A/D) to resistance (Rhead), and conversion table CT is a table of values in this relationship.

FIG. 4 shows an example of the conversion table CT. As shown in FIG. 4, the conversion table CT contains the divided voltage (A/D) values and the corresponding resistance (Ω) obtained from equation (1). As a result, by using conversion table CT, the resistance (Rhead) of the head element being measured can be quickly acquired from the measured (acquired) A/D value during inspection (when determining deterioration).

This conversion table CT is stored in the printer before shipping from the factory. Note that, because there are deviations between printers 2 due to the circuit board pattern and the resistance of various elements, actual measurements may be taken, and the values (resistance or A/D) in the conversion table CT may be adjusted according to the actual measurements. In this event, the conversion table CT is created for a specific printer 2, and stored in the printer 2.

The process of acquiring the initial values of the head elements (RH-1 to RH-n) is described next.

The resistance of the heat elements (resistive elements) of the head elements (RH-1 to RH-n) is known to change as the heat elements deteriorate. There are various symptoms of the method of change, one of which is a gradual increase in resistance. Another symptom is a gradual decrease in resistance followed by a sudden increase. In both cases, when the resistance rises a certain amount, insufficient heat is produced when printing and printing problems result.

Knowing the change in the resistance of the head elements (RH-1 to RH-n) (heat elements) in stages is therefore important to evaluation of the deterioration of the head elements (RH-1 to RH-n).

After executing the process (initial value acquisition process) of determining the initial value of each head element (RH-1 to RH-n), the printer 2 in this example thereafter measures the current value (state value) at an appropriate interval (frequency), and uses the initial value and the current state value to evaluate deterioration.

Figure 5:
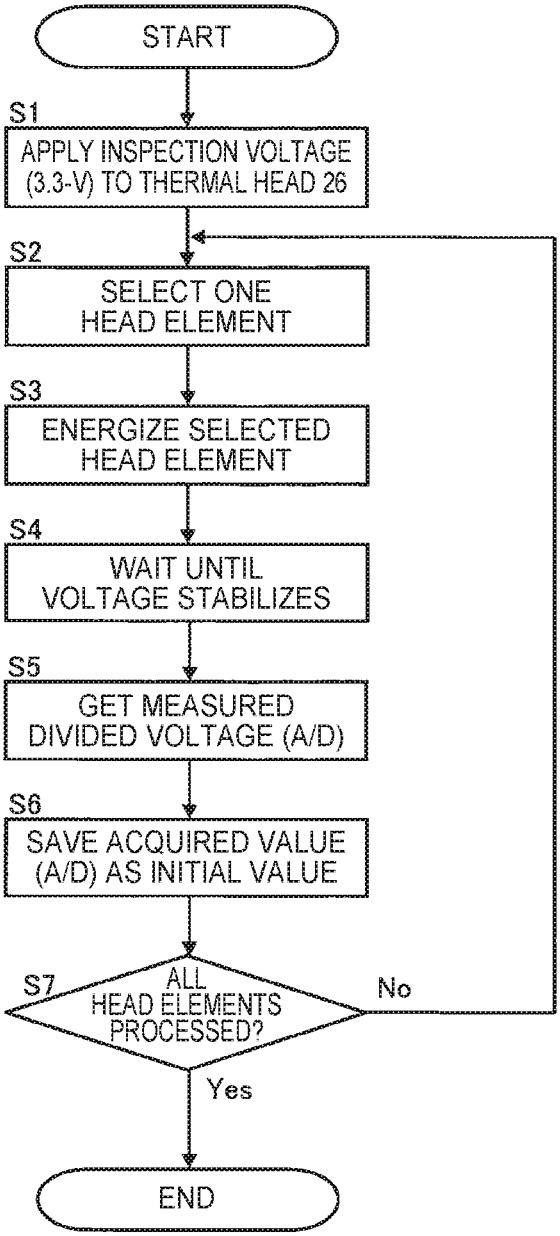
FIG. 5 is a flow chart showing an example of the initial value acquisition process.

FIG. 5 is a flow chart showing steps in the initial value acquisition process. The initial value acquisition process is executed the first time the printer 2 turns on.

As described above, the head controller 23 first outputs a signal to the voltage application circuit 25, and applies the inspection voltage (3.3-V) to the thermal head 26 (step S1 in FIG. 5).

Next, the head controller 23 selects one head element (RH-1 to RH-n) for which to acquire the initial value, and energizes that head element (RH-1 to RH-n) (steps S2 and S3 in FIG. 5). More specifically, as described above, the head controller 23 outputs the DI signal to the thermal head 26 to energize the head element.

As a result, a series circuit connecting the inspection resistor R1 and the resistive element (heat element) of the targeted head element is formed, and after waiting for the voltage to stabilize (step S4 in FIG. 5), the head controller 23 measures the divided voltage (A/D) between the inspection resistor R1 and the resistive element (heat element) of the head element when the READ_HEAD signal is applied (step S5 in FIG. 5). In other words, information corresponding to the initial resistance of the (resistive element (heat element)) of the head element is acquired.

Next, the head controller 23 stores (saves) the acquired A/D value as the initial value of the head element in the data storage 24 (step S6 in FIG. 5).

Note that the acquired A/D value may be converted to a resistance value using the conversion table CT stored in the data storage 24, and the converted resistance value may be stored as the initial value in the data storage 24. By using the A/D value as the initial value, the amount of data stored can be reduced to 1 byte.

The head controller 23 applies the initial value acquisition process (steps S2 to S6) to all head elements (RH-1 to RH-n) (step S7 in FIG. 5: No).

When the initial value acquisition process has been applied to all head elements (RH-1 to RH-n) (step S7 in FIG. 5: Yes), the process ends and initial value data is stored for all head elements (RH-1 to RH-n) in the data storage 24.

The deterioration evaluation process is described next. After the initial value acquisition process is completed, the printer 2 is used, and a specific timing is reached, the head controller 23 executes the deterioration evaluation process. This specific timing is described next.

The head controller 23 first executes a state value acquisition process.

Figure 6:
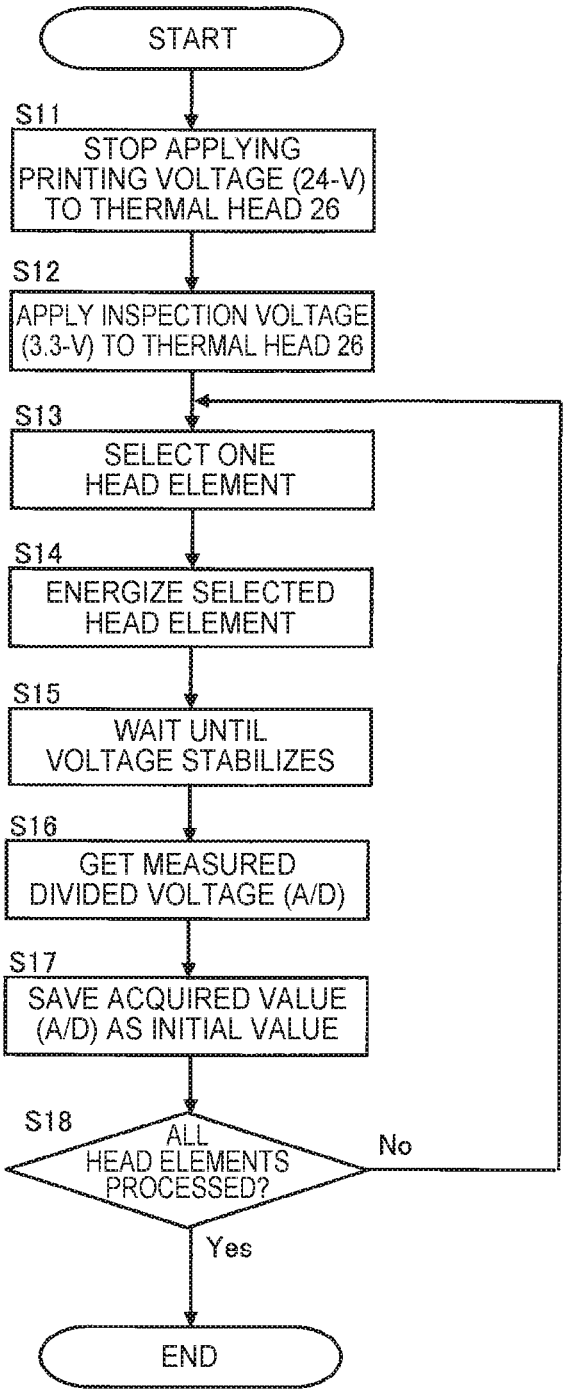
FIG. 6 is a flow chart showing an example of the state value acquisition process.

FIG. 6 is a flow chart of the state value acquisition process. As described above, the head controller 23 first outputs a signal to the voltage application circuit 25 to stop applying the printing voltage (24-V) to the thermal head 26 (step S11 in FIG. 6). The head controller 23 then outputs a signal to the voltage application circuit 25 as described above to apply the inspection voltage (3.3-V) to the thermal head 26 (step S12 in FIG. 6).

Next, the head controller 23 selects one head element (RH-1 to RH-n) for which to acquire the state value, and energizes that head element (RH-1 to RH-n) (steps S13 and S14 in FIG. 6). More specifically, as described above, the head controller 23 outputs the DI signal to the thermal head 26 to energize the head element.

As a result, a series circuit connecting the inspection resistor R1 and the resistive element (heat element) of the targeted head element is formed, and after waiting for the voltage to stabilize (step S15 in FIG. 6), the head controller 23 measures the divided voltage (A/D) between the inspection resistor R1 and the resistive element (heat element) of the head element when the READ_HEAD signal is applied (step S16 in FIG. 6). In other words, information corresponding to the current resistance of the (resistive element (heat element)) of the head element is acquired.

Next, the head controller 23 stores (saves) the acquired A/D value as the state value of the head element in the data storage 24 (step S17 in FIG. 6). Note that the state value may be stored in RAM in the head controller 23.

Note that the acquired A/D value may be converted to a resistance value using the conversion table CT stored in the data storage 24, and the converted resistance value may be stored as the state value in the data storage 24. By using the A/D value as the initial value, the amount of data stored can be reduced to 1 byte.

The head controller 23 applies the state value acquisition process (steps S13-S17) to all head elements (RH-1 to RH-n) (step S18 in FIG. 6: No).

When the state value acquisition process has been applied to all head elements (RH-1 to RH-n) (step S18 in FIG. 6: Yes), the process ends and state value data is stored for all head elements (RH-1 to RH-n) in the data storage 24.

The head controller 23 then executes a deterioration information acquisition process (rate of resistance change acquisition process).

Figure 7:
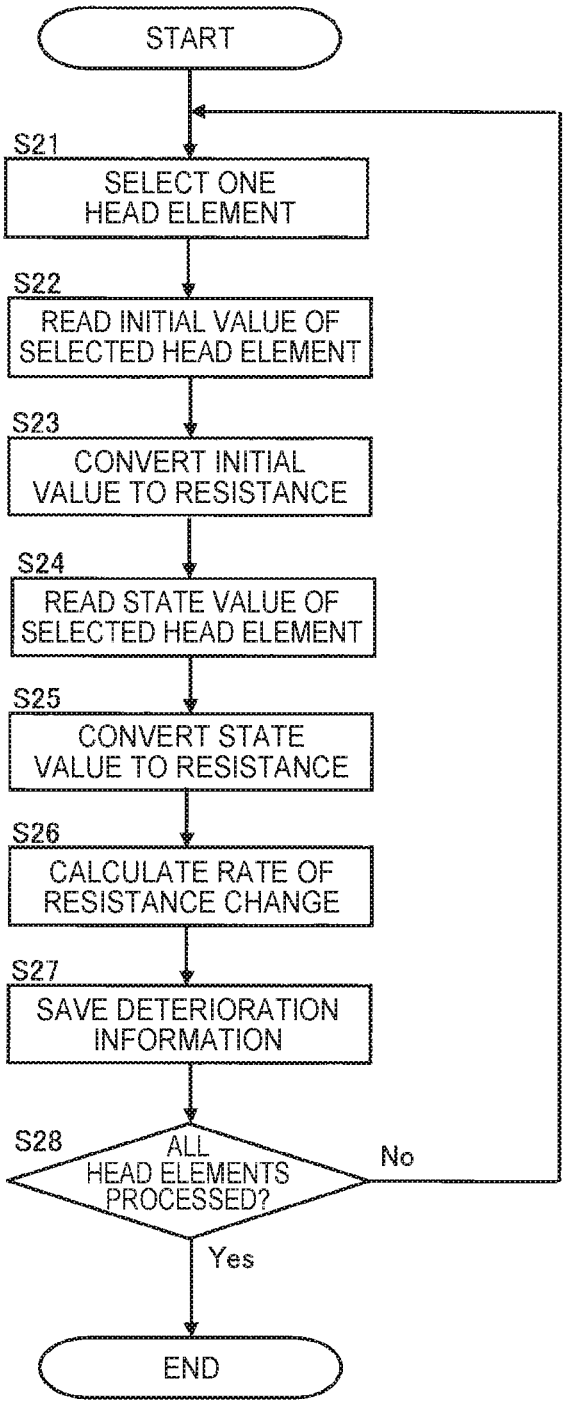
FIG. 7 is a flow chart showing an example of the deterioration information acquisition process.

FIG. 7 is a flow chart of the deterioration information acquisition process.

As described above, the head controller 23 first selects one head element (RH-1 to RH-n) (step S21 in FIG. 7). Next, the head controller 23 accesses the data storage 24 and retrieves the initial value for the selected head element (RH-1 to RH-n) (step S22 in FIG. 7). This initial value is the value that was acquired and stored in the initial value acquisition process described above.

The head controller 23 then converts the retrieved initial value to a resistance value using the conversion table CT stored in the data storage 24 (step S23 in FIG. 7). Because this initial value is an A/D value, the initial value can be converted to resistance by reading the resistance (Ω) stored for that A/D value in the conversion table CT.

Next, the head controller 23 accesses the data storage 24 and retrieves the state value of the selected head element (RH-1 to RH-n) (step S24 in FIG. 7). This state value is the state value acquired and stored in the state value acquisition process described above.

Using the conversion table CT stored in the data storage 24, the head controller 23 then converts the read state value to resistance (step S25 in FIG. 7). Because this initial value is an A/D value, the initial value can be converted to resistance by reading the resistance (Ω) stored for that A/D value in the conversion table CT.

Next, the head controller 23 calculates the rate of change in the resistance (step S26 in FIG. 7) using equation below.

$$\text{rate of resistance change (\%)} = (\text{state value } (\Omega) - \text{initial value } (\Omega))/\text{initial value } (\Omega) \times 100 \quad (2)$$

Note that the initial value (Ω) is the initial value converted to resistance in step S23, and the state value (Ω) is the state value converted to resistance in step S25.

A negative rate of resistance change means that the resistance of the head element (RH-1 to RH-n) is decreasing, and a positive rate of resistance change means that the resistance of the head element (RH-1 to RH-n) is increasing.

As described above, if deterioration of the head element (RH-1 to RH-n) is advancing, its resistance may be decreasing or increasing, and in either case, if the absolute value of the rate of resistance change is greater than or equal to a specific value, the user is informed because dropped dots may result.

The head controller 23 then compares the calculated rate of resistance change with a previously set threshold, and determines if the rate of resistance change exceeds the threshold. In this example, thresholds of 15% and 30% (absolute value) are set.

The head controller 23 then stores (saves) the result of the decision using the calculated rate of resistance change and the threshold as deterioration information in the data storage 24 (step S27 in FIG. 7).

FIG. 8 shows an example of the deterioration information. The deterioration information shown in FIG. 8 is information relating the calculated rate of resistance change of each head element (RH-1 to RH-n), and an alarm flag as the decision result using the threshold, to the identification information (head element No.) of each head element (RH-1 to RH-n). This information is stored (saved) in the data storage 24.

The example shown in FIG. 8 uses four thresholds, 15%, 30%, −15%, −30%. Thresholds 15% and −15% are standards indicating a light degree of deterioration, and the alarm flag of a head element (RH-1 to RH-n) exceeding the threshold (less than the threshold in the case of −15%) is set to ON(A). Thresholds 30% and −30% are standards indicating a strong degree of deterioration, and the alarm flag of a head element (RH-1 to RH-n) exceeding the threshold (less than the threshold in the case of −30%) is set to ON(B). The alarm flag is set to OFF for any head element (RH-1 to RH-n) not exceeding the threshold.

For example, in FIG. 8, the rate of resistance change is 5% for the head element (RH-1 to RH-n) of head element No. 2, and the alarm flag is therefore set OFF. The rate of resistance change is −18% for the head element (RH-1 to RH-n) of head element No. 61, and the alarm flag is therefore set to ON(A). The rate of resistance change is 33% for the head element (RH-1 to RH-n) of head element No. 150, and the alarm flag is therefore set to ON(B).

Based on this deterioration information, deterioration of the head element (RH-1 to RH-n) of head element No. 2 is determined to have not advanced appreciably; deterioration of the head element (RH-1 to RH-n) of head element No. 61 is determined to have advanced moderately; and deterioration of the head element (RH-1 to RH-n) of head element No. 150 is determined to have advanced significantly.

The head controller 23 applies the foregoing deterioration information acquisition process (S21-S27) to all head elements (RH-1 to RH-n) (step S28 in FIG. 7: No).

If the deterioration information acquisition process has been applied to all head elements (RH-1 to RH-n) (step S28 in FIG. 7: Yes), the process ends, and the deterioration information for all head elements (RH-1 to RH-n) is stored in the data storage 24.

As described above, the timing for running the deterioration evaluation process (state value acquisition process and deterioration information acquisition process) may be when the printer 2 power turns on, when a specific operating time has passed, or when a specific amount of printing has been done.

The deterioration information acquisition process is executed after acquiring state values for all head elements (RH-1 to RH-n) in the example above, but may be configured to run continuously to acquiring the state value and acquiring the deterioration information for each head element (RH-1 to RH-n).

Figure 9:
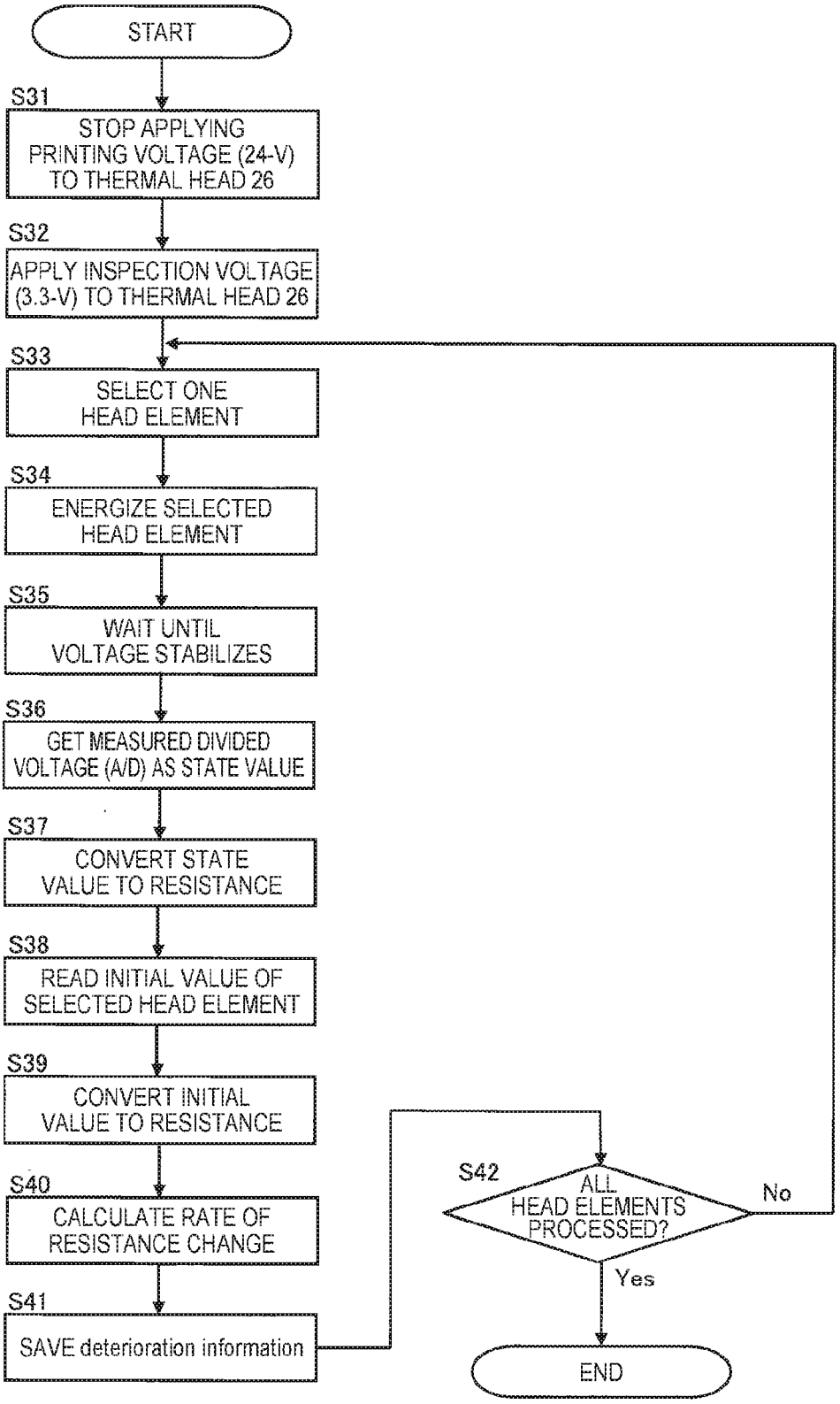
FIG. 9 is a flow chart of a deterioration evaluation process in another aspect of the invention.

FIG. 9 is a flow chart of another example of the deterioration evaluation process. In this example, the head controller 23 first outputs a signal to the voltage application circuit 25 and interrupts applying the printing voltage (24-V) to the thermal head 26 (step S31 in FIG. 9). The head controller 23 then outputs a signal to the voltage application circuit 25 as described above to apply the inspection voltage (3.3-V) to the thermal head 26 (step S32 in FIG. 9).

Next, the head controller 23 selects one head element (RH-1 to RH-n) and energizes that head element (RH-1 to RH-n) (steps S33 and S34 in FIG. 5). More specifically, as described above, the head controller 23 outputs the DI signal to energize the head element.

As a result, a series circuit connecting the inspection resistor R1 and the resistive element (heat element) of the head element is formed, and after waiting for the voltage to stabilize (step S35 in FIG. 9), the head controller 23 acquires the measured value (A/D) of the divided voltage between the inspection resistor R1 and the resistive element (heat element) of the head element when the READ_HEAD signal is applied (step S36 in FIG. 9). In other words, information corresponding to the resistance of the (resistive element (heat element)) of the head element at that time is acquired.

The head controller 23 then converts the acquired state value to a resistance value using the conversion table CT stored in the data storage 24 (step S37 in FIG. 9). Because the state value that is read is an A/D value, the state value can be converted to resistance by reading the resistance (Ω) stored for that A/D value from the conversion table CT.

Next, the head controller 23 accesses the data storage 24 and retrieves the initial value for the selected head element (RH-1 to RH-n) (step S38 in FIG. 9). This initial value is the initial value acquired and stored in the initial value acquisition process described above.

Using the conversion table CT stored in the data storage 24, the head controller 23 then converts the read initial value to resistance (step S39 in FIG. 9). Because this initial value is an A/D value, the initial value can be converted to resistance by reading the resistance (Ω) stored for that A/D value from the conversion table CT.

Next, the head controller 23 calculates the rate of change in the resistance (step S40 in FIG. 9) using the equation below. This step is the same as step S26 in FIG. 7 described above.

The head controller 23 then stores (saves) the deterioration information in the data storage 24 (step S41 in FIG. 9). This operation is the same as step S27 in FIG. 7.

The head controller 23 applies the deterioration information acquisition process described above (S31-S41) to all head elements (RH-1 to RH-n) (step S42 in FIG. 9: No).

If the deterioration information acquisition process has been applied to all head elements (RH-1 to RH-n) (step S42 in FIG. 9: Yes), the process ends, and deterioration information for all head elements (RH-1 to RH-n) is stored in the data storage 24.

This completes this example of the deterioration evaluation process.

The POS terminal device 1 may run the deterioration evaluation process when an instruction (command) is received from the deterioration manager server 3 or other external device (host device). In this event, there is a command for the printer 2 instructing the executing of the deterioration evaluation process, and this command is sent from the host device to the printer 2, causing the printer 2 to execute the deterioration evaluation process. The transmitted command is received by the communicator 21 of the printer 2, and the main controller 22 interprets the command and instructs the head controller 23 to execute the deterioration evaluation process. After executing the deterioration evaluation process as described above, the head controller 23 passes the deterioration information stored in the data storage 24 to the main controller 22, and the main controller 22 returns the deterioration information through the communicator 21 to the host device that sent the deterioration evaluation process command.

When the host device is the POS terminal device 1, the deterioration manager 13 sends the command, and stores the deterioration information that is returned so that the deterioration information can be used in a maintenance process, for example. When the host device is the deterioration manager server 3, the deterioration manager server 3 sends the above command, and stores the returned deterioration information so that it can be used in maintenance processes.

For such a host device that manages deterioration of the head elements using such a command transmitted from the host device (POS terminal device 1 or deterioration manager server 3, for example), the initial value acquisition process and a command instructing the initial value acquisition process are prepared, and the initial value acquisition process may be executed on the printer 2 by sending this command from the host device. The printer 2 may also return the divided voltage (A/D) of each head element measured to the host device, and store the divided voltage (A/D) as the initial value. In the deterioration evaluation process in this case, the printer 2 returns the divided voltage (A/D) of the measured head element to the host device, and the host device executes the deterioration evaluation process (resistance conversion, threshold comparison, storing deterioration information) using the stored conversion table CT. Note that when the host device is the POS terminal device 1, the deterioration manager 13 executes these processes.

In another example, an auto status back (ASB) function may also be applied to the method whereby the host device (POS terminal device 1 or deterioration manager server 3, for example) acquires deterioration information for the head elements. The host device and printer are normally in a master-slave relationship, and the printer normally does not automatically send information the host device. The printer may be configured to automatically send specific status information to the host device when there is a change in the state corresponding to that status information, and this function of a printer is called an auto status back function. By implementing such a function, the printer can automatically send deterioration information to the host device when there is a change in the deterioration information stored in the data storage 24. In this event, the head controller 23 reads the deterioration information from the data storage 24, and sends the read deterioration information from the main controller 22 through the communicator 21 to the host device (such as the deterioration manager 13 of the POS terminal device 1 in this example).

A configuration that provides deterioration information to the host device side (POS terminal device 1 or deterioration manager server 3, for example) is also conceivable. More specifically, the host device sends commands to a printer 2, and the printer 2 (head controller 23) receiving the commands sends the measured divided voltage and/or the decision based on a previously set threshold (the result of the deterioration evaluation process using the threshold described above, deterioration information) to the host device.

The deterioration evaluation process of the printer 2 may also be enabled/disabled (to execute or not execute), and the timing for execution, can be set based on a command from the host device.

In another example, the deterioration evaluation process that executes for one head element at a time may be applied to two or more head elements (a group including plural head elements) at a time. More specifically, each of the head elements included in the group is energized, the divided voltage is measured, and the collective degree of deterioration of the group is determined. If there is a group for which the degree of deterioration (rate of resistance change) is great, this method then repeats the deterioration evaluation process on the individual head elements in that group. This method can reduce the number of times the deterioration evaluation process (measuring the divided voltage)

executes, and shorten the total processing time. Note that to improve the measurement precision in this case, a multiplexer may be used to change the resistance of the inspection resistor R1, for example.

Because the printer 2 in the foregoing embodiments can evaluate the deterioration of each head element from the resistance at a specific timing, and stores a conversion table CT, the amount of data stored in the printer 2 can be suppressed.

Deterioration can also be accurately evaluated because the initial value (divided voltage (A/D value), resistance (Ω)) of each head element is used to determine deterioration.

Because the deterioration information includes the rate of resistance change of the head elements, an accurate evaluation of deterioration is possible.

Furthermore, the A/D values stored until the rate of resistance change is calculated are less than 4 bytes of data, the amount of data stored can be suppressed.

The first time a printer 2 according to the second embodiment of the invention turns on, the printer 2 measures and stores the resistance (divided voltage) of each head element (RH-1 to RH-n) in the thermal head 26 of the printer 2. Timed to cutting the print medium (such as roll paper) with the automatic cutter 27 during the printing process, the printer 2 again measures the resistance (divided voltage) of each head element (RH-1 to RH-n). The printer 2 then evaluates the state of deterioration of each head element (RH-1 to RH-n) from the rate of resistance change calculated from the current resistance value and the initial resistance (divided voltage) that was previously stored. Information related to the measured values and/or evaluation results may also be sent to an external device (such as the POS terminal device 1 or deterioration manager server 3.

As a result, the state of deterioration of each head element (RH-1 to RH-n) can be determined in stages. Because the deterioration detection process is executed during cutting of the print medium, for example, deterioration can be detected without interfering with the printing process. The host device can also easily monitor printer 2 deterioration.

The configuration of the printer 2, printer system 100, and deterioration management system 200 in the second embodiment of the invention are the same as in the first embodiment described above. The second embodiment is therefore also described with reference to FIG. 1 and FIG. 2.

A printer 2 according to the second embodiment of the invention is characterized by the process for evaluating deterioration of the head elements (RH-1 to RH-n), and the content of this process is described below.

As in the first embodiment, the process (initial value acquisition process) of acquiring a value representing the initial state (initial value) of each head element (RH-1 to RH-n) is executed first. A value (state value) representing the state at that time is then measured at a specific time, and deterioration is evaluated based on the initial value and the current state value.

The specific timing for executing the deterioration evaluation process is a major feature of this printer 2, and more specifically is when the print medium is cut after the printing process ends. During the process of cutting the print medium, the printing process is stopped and cannot execute. When the printer 2 according to this embodiment detects that the cutting process executes and the printing process cannot execute, the printer 2 executes the deterioration evaluation process on the head elements.

Figure 10:
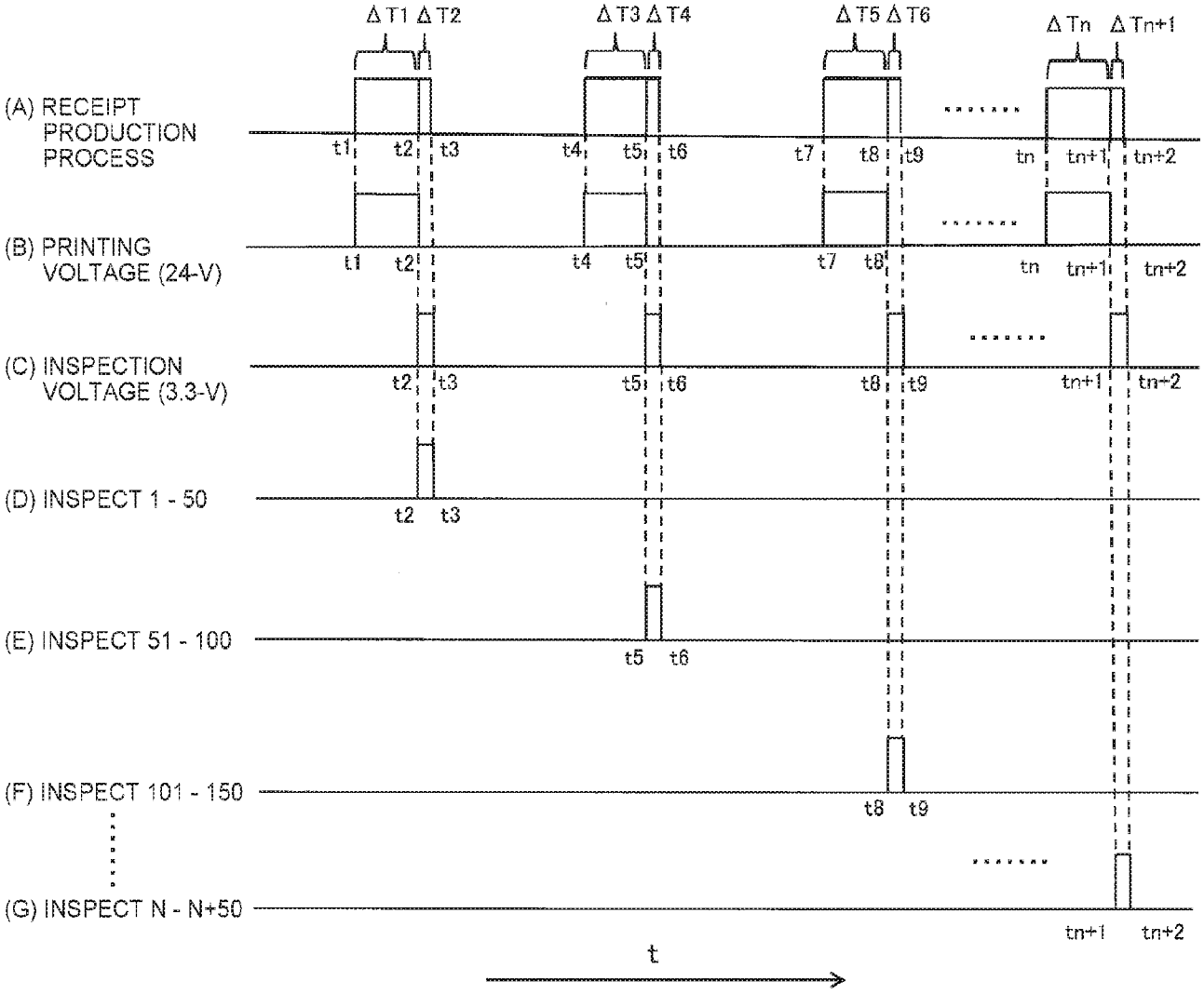
FIG. 10 is a timing chart showing the timing of the deterioration evaluation process executed by the printer 2.

FIG. 10 is a timing chart showing the timing of the deterioration evaluation process executed by the printer 2. In FIG. 10, time t is shown on the X-axis. The Y-axis indicates when the process executes (high) and does not execute (low), and when a voltage is on (high) and off (low).

Row (A) in FIG. 10 shows execution of the receipt printing process. Peaks in the timing chart (ΔT1 and ΔT2, ΔT3 and ΔT4, ΔT5 and ΔT6, . . . ΔTn and ΔTn+1) indicate when a process producing one receipt executes. The first peak in each pair (ΔT1, ΔT3, ΔT5, . . . ΔTn) indicates a printing process, and the second peak (ΔT2, ΔT4, ΔT6, . . . ΔTn+1) represents a cutting process. For example, time ΔT1 (from t1 to t2) is when signals are output by the head controller 23 to the voltage application circuit 25, voltage is applied to the thermal head 26, and a receipt is printed. Time ΔT2 (from t2 to t3) is when the automatic cutter 27 is controlled by the main controller 22 to cut the receipt.

Row (B) shows the timing when the printing voltage (24-V) is applied to the thermal head 26 to print the above receipt. The peaks in row (B) match the printing process (ΔT1, ΔT3, ΔT5, . . . ΔTn) in (A). When printing a receipt in the printing process (ΔT1, ΔT3, ΔT5, . . . ΔTn) in (A) ends, the head controller 23 controls the voltage application circuit 25 to stop applying the printing voltage (24-V) to the thermal head 26.

Row (C) shows the timing when the inspection voltage (3.3-V) is applied to the thermal head 26. The peaks in row (C) match the printing process (ΔT1, ΔT3, ΔT5, . . . ΔTn) in (A). At the start of the printing process (ΔT1, ΔT3, ΔT5, . . . ΔTn) in (A), the head controller 23 controls the voltage application circuit 25 to apply the inspection voltage (3.3-V) to the thermal head 26.

Rows (D) to (G) show the timing of the deterioration evaluation process. The timing of the deterioration evaluation process matches the timing when the inspection voltage (3.3-V) shown in (C) and the timing of the cutting process (ΔT2, ΔT4, ΔT6, . . . ΔTn+1) in (A) occur. In this example, 50 head elements are processed during each deterioration evaluation process executed in (D) to (G). The number of head elements inspected at one time is not limited to 50, and any desirable number that can be completely processed during the cutting process (ΔT2, ΔT4, ΔT6, . . . ΔTn+1) in (A) may be selected.

The printer 2 in this example thus applies the deterioration evaluation process to a specific number of head elements, that is, a subset of the total number of head elements, while the automatic cutter 27 is cutting the receipt paper. In other words, instead of applying the deterioration evaluation process continuously to all head elements, the printer 2 applies the deterioration evaluation process to a number of head elements that can be completely tested during a time when the printing process cannot be executed.

The content of the deterioration evaluation process is described further below. As described above, the deterioration evaluation process is executed during the period of one cycle, that is, the time required to produce one receipt, and processing during this one cycle until a receipt is produced is described next.

Figure 11:
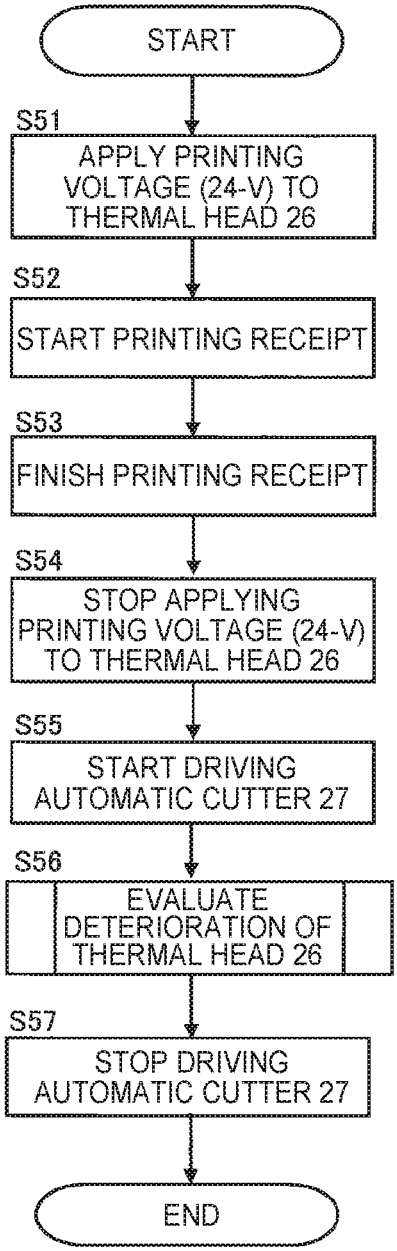
FIG. 11 is a flow chart showing steps in one cycle of the receipt printing process.

FIG. 11 is a flow chart of the steps during one receipt print cycle. The head controller 23 first receives instructions to print a receipt from the main controller 22, outputs a signal to the voltage application circuit 25, and applies the printing voltage (24-V) to the thermal head 26 (step S51 in FIG. 11).

Next, based on the print data received from the POS application 11, the main controller 22 starts the receipt printing process (step S52 in FIG. 11). More specifically, the main controller 22 controls the paper conveyor 28 to convey the print medium sequentially to the printing position of the thermal head 26 (step S52 in FIG. 11).

The head controller 23 is then instructed to print on the conveyed print medium. When printing the receipt ends (step S53 in FIG. 11), the head controller 23 outputs a signal to the voltage application circuit 25 to stop applying the printing voltage (24-V) to the thermal head 26 (step S54 in FIG. 11).

Next, the main controller 22 drives the automatic cutter 27 to start cutting the print medium (step S55 in FIG. 11). The head controller 23 receives a signal to start driving the automatic cutter 27 from the main controller 22, and applies the deterioration evaluation process to the thermal head 26 (step S56 in FIG. 11). More specifically, the head controller 23 detects the cutting process during which printing is not possible, and starts the deterioration evaluation process. The specific content of the deterioration evaluation process is described further below.

When the automatic cutter 27 finishes cutting the print medium, the main controller 22 stops driving the automatic cutter 27 and the print medium cutting process ends (step S57 in FIG. 11).

The process of producing one receipt is thus completed. This process is executed by the printer 2 each time a request to print a receipt is received from the POS terminal device 1.

The deterioration evaluation process executed in step S56 in FIG. 11 is the same as the deterioration evaluation process of the first embodiment. More specifically, the same process described above with reference to FIG. 6 to FIG. 9 is executed, except that the test in step S18 in FIG. 6 and step S42 in FIG. 9 is whether processing a specific number of head elements is completed instead of whether process all head elements is completed as described above.

Note that the number of head elements (the "specific number" of the specific number of head elements inspected in step S18 in FIG. 6 and step S42 in FIG. 9) to which the deterioration evaluation process is applied during the cutting process of the automatic cutter 27 is previously set to a number for which the deterioration evaluation process can be completed during the period of the cutting process. If the specific number is 50 and the total number of head elements is 512, the deterioration evaluation process can be completed for all head elements during the time required to produce approximately 10 receipts.

The timing of the deterioration evaluation process is also not limited to when the automatic cutter 27 cuts the print medium, and may at any appropriate time when a receipt printing process cannot be executed. For example, the deterioration evaluation process may execute whenever the printing operation of the printer 2 is stopped, such as when the print medium runs out and the operator opens the cover 29 to open the print medium storage unit, and when an error occurs in the printer 2. In the first case, the head controller 23 detects a signal from the main controller 22 indicating that the storage unit was opened, that is, detects that printing is not possible, and starts the deterioration evaluation process. In the latter case, the head controller 23 detects the error signal from the main controller 22, that is, detects that the printer 2 cannot print, and starts the deterioration evaluation process.

Note that variations such as managing device deterioration on the host device (POS terminal device 1, deterioration manager server 3) side are possible as described in the first embodiment.

Because the head elements can be inspected using times when printing cannot execute, such as when cutting the print medium, a printer 2 according to the foregoing embodiments and variations can desirably evaluate deterioration of the head elements without interfering with the printing process and without requiring extra circuitry for testing the head elements parallel to the printing process, and there is obviously no need to increase the size of the circuitry.

Furthermore, because the state of deterioration of the head elements is evaluated based on the initial divided voltage acquired during the initial configuration process, deterioration of the head elements can be accurately determined.

Furthermore, because the deterioration evaluation process is not applied continuously to all head elements, and is instead applied to a specific number of head elements that can all be inspected during the cutting process or other time when printing is not possible, interfering with the printing process can be reliably prevented.

Furthermore, because the deterioration evaluation process uses multiple threshold values that are previously set for specific divided voltages, the state of deterioration of the head elements can be managed more precisely.

Furthermore, because the deterioration evaluation process executes during the print medium cutting operation, processing does not interfere with the printing process. Furthermore, the head elements can also be reliably inspected because the print media printing and cutting operations are executed for as long as the printer 2 is used.

Interference with the printing process can also be avoided by evaluating the deterioration of the head elements when the cover 29 is open or when an error occurs, for example.

As described above, by applying the deterioration evaluation process to the head elements when the receipt printing operation cannot execute, deterioration of the head elements can be inspected without interfering with the operations of business in which receipt printers are always in use, such as in restaurants or bars, and convenience stores, that are open 24 hours a day.

A printer 2 according to the third embodiment of the invention has a reverse current protection circuit (reverse current protection FET) that uses a smoothing capacitor C1 on the printer side, or a FET (field effect transistor) on the inspection circuit side, in the voltage application circuit 25 that applies voltage to the thermal head 26 (printhead); and attempts to shorten the deterioration detection time when detecting deterioration of the head elements (RH-1 to RH-n) of the thermal head 26 by the printer 2 by instantly discharging the residual charge in the smoothing capacitor C1 by energizing all head elements (RH-1 to RH-n).

Figure 12:
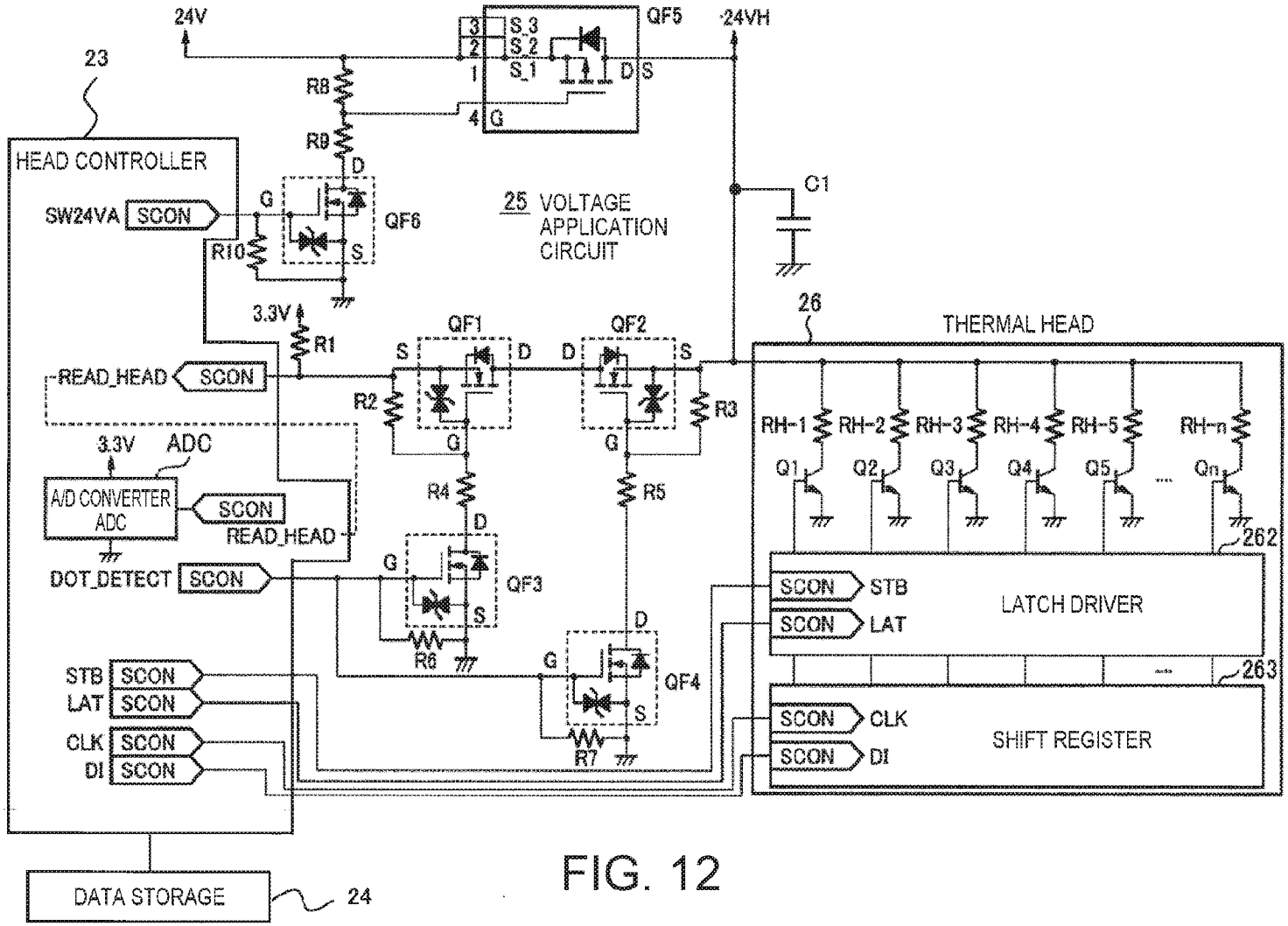
FIG. 12 is a circuit diagram showing an example of the voltage application circuit 25 and thermal head 26 in a third embodiment of the invention.

The configuration of the printer 2, printer system 100, and deterioration management system 200 in the third embodiment of the invention are the same as in the first embodiment described above. This embodiment is therefore also described with reference to FIG. 1 and FIG. 2. This embodiment differs from the voltage application circuit 25 and thermal head 26 circuit shown in FIG. 2 in the addition of a smoothing capacitor C1 as shown in FIG. 12.

The smoothing capacitor C1 (capacitor) is disposed between the printing voltage control FET QF5 and the head elements (RH-1 to RH-n) to remove noise. The smoothing capacitor C1 is also disposed adjacent to the head elements (RH-1 to RH-n). A charge remains in the smoothing capacitor C1 after the printing process. The printer 2 according to this embodiment is characterized by discharging the smoothing capacitor C1 when detecting deterioration of the head elements (RH-1 to RH-n). This is described more specifically below.

Note that switch QF5 is the printing voltage control FET QF5; switch QF1 is the inspection voltage control FET, and switch QF2 is a reverse current protection control FET (reverse current protection FET). The switch QF2 (reverse current protection FET) is disposed between the inspection voltage supply and the head elements.

As described above, a printer 2 according to this embodiment is characterized by the deterioration detection process (inspection process) of the head elements (RH-1 to RH-n), the content of which is described further below.

At a specific time after the printer 2 starts, the head controller 23 runs the deterioration detection process. The specific timing of this process is described below.

Figure 13:
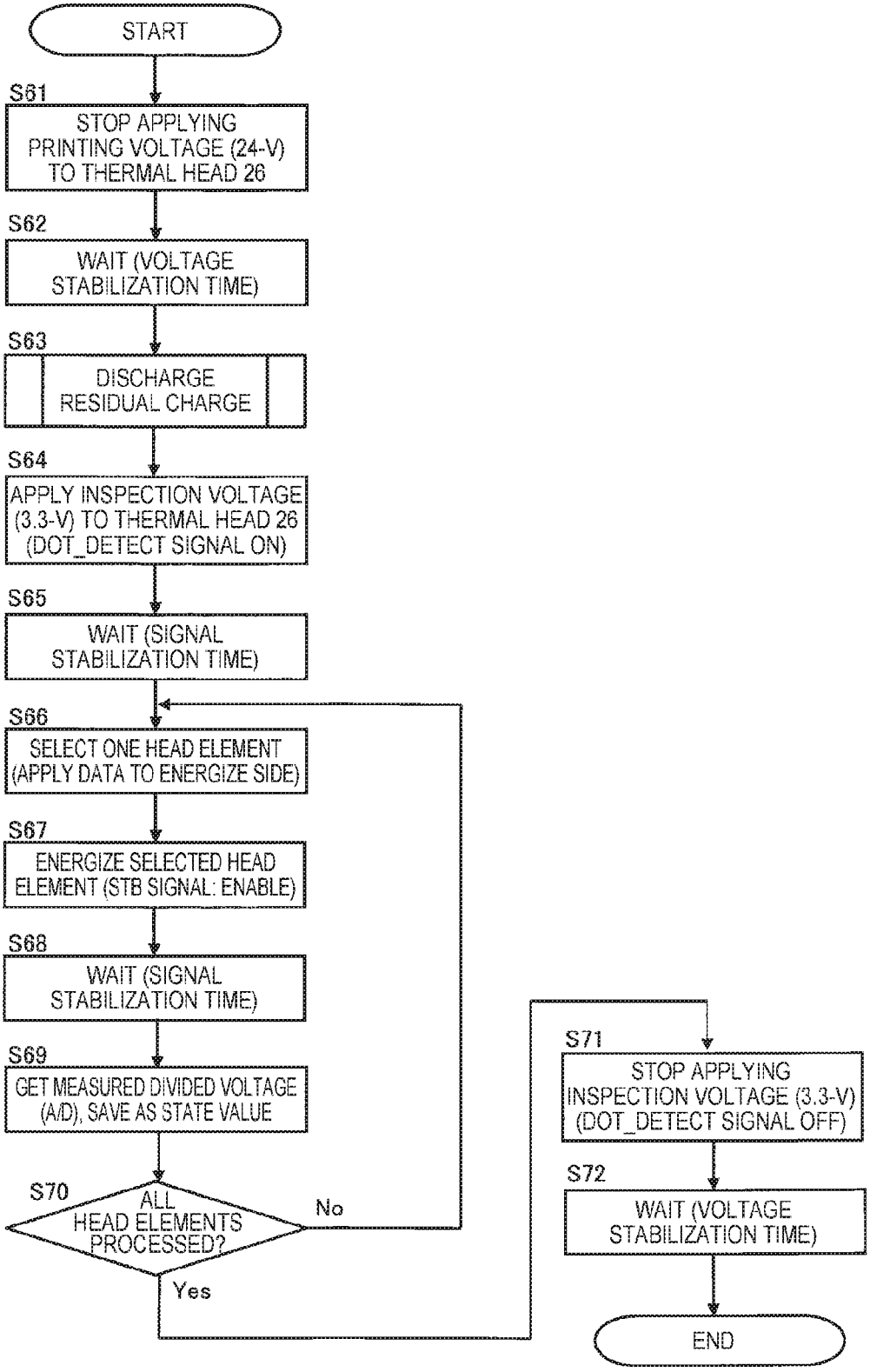
FIG. 13 is a flow chart showing steps in the deterioration detection process in a third embodiment of the invention.

FIG. 13 is a flow chart of steps in the deterioration detection process. As described above, the head controller 23 first outputs a signal to the voltage application circuit 25, and interrupts (stops) applying the printing voltage (24-V) to the thermal head 26 (step S61 in FIG. 13).

The head controller 23 then waits for a specific time (a previously set voltage OFF stabilization time) (step S62 in FIG. 13).

Next, the head controller 23 executes a process of discharging the residual charge in the smoothing capacitor C1 (step S63 in FIG. 13).

Figure 14:
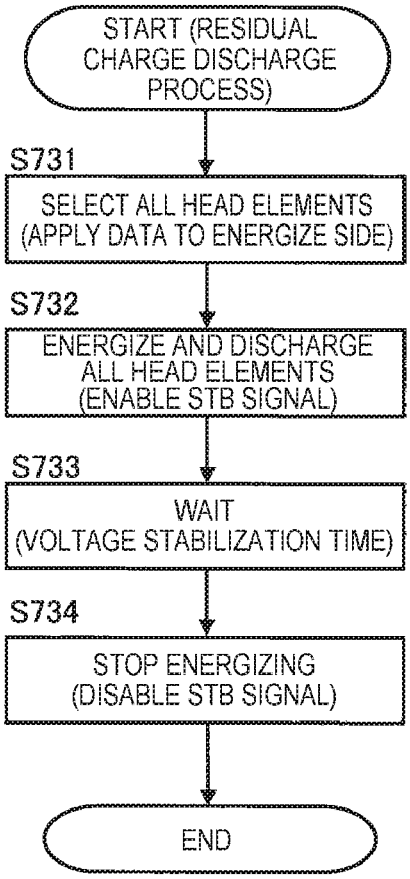
FIG. 14 is a flow chart showing steps in the residual charge discharge process.

FIG. 14 is a flow chart of this residual charge discharge process. Specific steps in the residual charge discharge process are described below based on FIG. 14. First, the head controller 23 selects all head elements (RH-1 to RH-n) (all dots ON). In other words, the head controller 23 sets the data on the energize side of all head elements (RH-1 to RH-n) (step S731 in FIG. 14).

The head controller 23 then energizes all head elements (RH-1 to RH-n). More specifically, the head controller 23 outputs a strobe signal (Enables the STB signal) to energize all head elements (RH-1 to RH-n) by means of the latch driver 262. The voltage of the smoothing capacitor C1 therefore drops, and the residual charge of the smoothing capacitor C1 is discharged (step S732 in FIG. 14).

After energizing, the head controller 23 waits for a specific time (a previously set voltage stabilization time) (step S733 in FIG. 14). This specific time is a time enabling (sufficiently) discharging the residual charge of the smoothing capacitor C1.

Because the residual charge of the smoothing capacitor C1 is substantially completely discharged during this time, the head controller 23 stops energizing all of the head elements (RH-1 to RH-n) (step S734 in FIG. 14). More specifically, the head controller 23 stops the strobe signal (Disables the STB signal).

Any residual charge in the smoothing capacitor C1 is thus discharged.

Next, the head controller 23 outputs a signal to the voltage application circuit 25 as described above, and applies the inspection voltage (3.3-V) to the thermal head 26 (step S64 in FIG. 13). More specifically, the head controller 23 turns the DOT_DETECT signal ON. Next, the head controller 23 waits for a specific time (a previously set signal stabilization time) (step S65 in FIG. 13).

Next, the head controller 23 selects one head element (RH-1 to RH-n) for which to acquire the state value. More specifically, the head controller 23 applies data to the energize side of the head elements (RH-1 to RH-n) (step S66 in FIG. 13). Note that this state value means a value indicating the current state of the particular head element (RH-1 to RH-n).

The head controller 23 then energizes the head element (RH-1 to RH-n). More specifically, the head controller 23 outputs a strobe signal (Enables the STB signal) to energize that head element (RH-1 to RH-n) by means of the latch driver 262 (step S67 in FIG. 13).

The head controller 23 then waits for a specific time (a previously set signal stabilization time) (step S68 in FIG. 13).

As a result, a series circuit connecting the inspection resistor R1 to the resistive element (heat element) of the head element (RH-1 to RH-n), the head controller 23 acquires the measured divided voltage (A/D value) between the inspection resistor R1 of the series circuit and the resistive element (heat element) of the head element (RH-1 to RH-n) when the READ_HEAD signal is applied (step S69 in FIG. 13). In other words, information corresponding to the resistance of that head element (resistive elements (heat element)) at that time is acquired. The head controller 23 then stores (saves) the acquired A/D value as the state value of that head element in the data storage 24 (step S69 in FIG. 13). Note that the state values may be stored in RAM in the head controller 23.

The A/D value in this example is a 1-byte value, and by expressing the state value with an A/D value, the amount of data to be stored can be kept to one byte. However, the A/D value is not limited to one byte, and may be a 4-byte value, for example.

The head controller 23 applies the foregoing state value acquisition process (S66 to S69) to all head elements (RH-1 to RH-n) (step S70 in FIG. 13: No).

When the state value acquisition process has been applied to all head elements (RH-1 to RH-n) (step S70 in FIG. 13: Yes), state value data is stored for all head elements (RH-1 to RH-n) in the data storage 24, and the head controller 23 stops applying the inspection voltage (3.3-V) to the thermal head 26 (step S71 in FIG. 13). More specifically, the head controller 23 turns the DOT_DETECT signal OFF. The head controller 23 then waits for a specific time (a previously set voltage OFF stabilization time) (step S72 in FIG. 13).

Deterioration of each head element (RH-1 to RH-n) is thus detected.

The printer 2 then applies the deterioration evaluation process to each head element (RH-1 to RH-n). More specifically, the printer 2 converts the state values stored as divided voltage (A/D values) to resistance, that is, calculates the resistance (state resistance) of the resistive elements (heat element) of each head element (RH-1 to RH-n), and compares the calculated resistance with the initial resistance (the resistance at the start of printer 2 use) of the resistive elements (heat element) of each head element (RH-1 to RH-n). More specifically, the printer 2 acquires the change (change in resistance) from the initial state resistance value.

The initial resistance may be the design resistance of the device, or the resistance measured the first time the printer 2 is used. If the measured value is used, the initial A/D value is acquired by the same process described in steps S64 to S72 in FIG. 13, and the initial resistance can be calculated from that A/D value.

The resistance of the heat element (resistive element) of a head element (RH-1 to RH-n) is known to change with deterioration over time. There are various symptoms of the method of change, one of which is a gradual increase in resistance. Another symptom is a gradual decrease in resistance followed by a sudden increase. In both cases, when the resistance rises a certain amount, insufficient heat is produced when printing and printing problems result.

Therefore, if the (absolute value of the) rate of resistance change is greater than a specific value (such as greater than 15%), deterioration of that head element (RH-1 to RH-n) can be determined to be advanced.

The head controller 23 evaluates each head element (RH-1 to RH-n), and stores the results as deterioration information in the data storage 24.

The stored deterioration information enables managing deterioration of the head elements (RH-1 to RH-n) in various ways. When the printer 2 manages deterioration, deterioration information may be displayed on a display device (not shown in the figure) of the printer 2, and based on the displayed information the operator of the printer 2 may perform a particular maintenance process, such as replacing the head element (RH-1 to RH-n).

When the POS terminal device 1 manages deterioration, the stored deterioration information is sent at a specific time from the printer 2 to the POS terminal device 1, and based on this information the deterioration manager 13 applies the deterioration management process to the head elements (RH-1 to RH-n).

When the deterioration manager server 3 manages deterioration, the stored deterioration information is sent at a specific time from the printer 2 directly or through the POS terminal device 1 to the deterioration manager server 3, and based on this information the deterioration manager 13 applies the deterioration management process to the head elements (RH-1 to RH-n).

Figure 15:
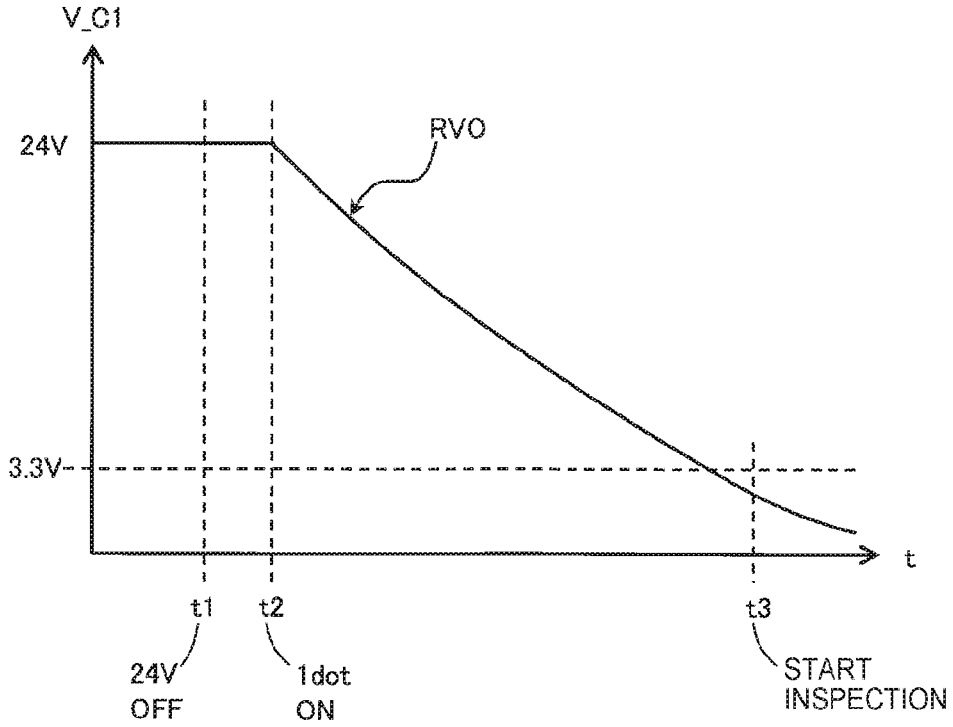
FIG. 15 illustrates the change in the voltage drop of the smoothing capacitor C1 when the invention is not used.
Figure 16:
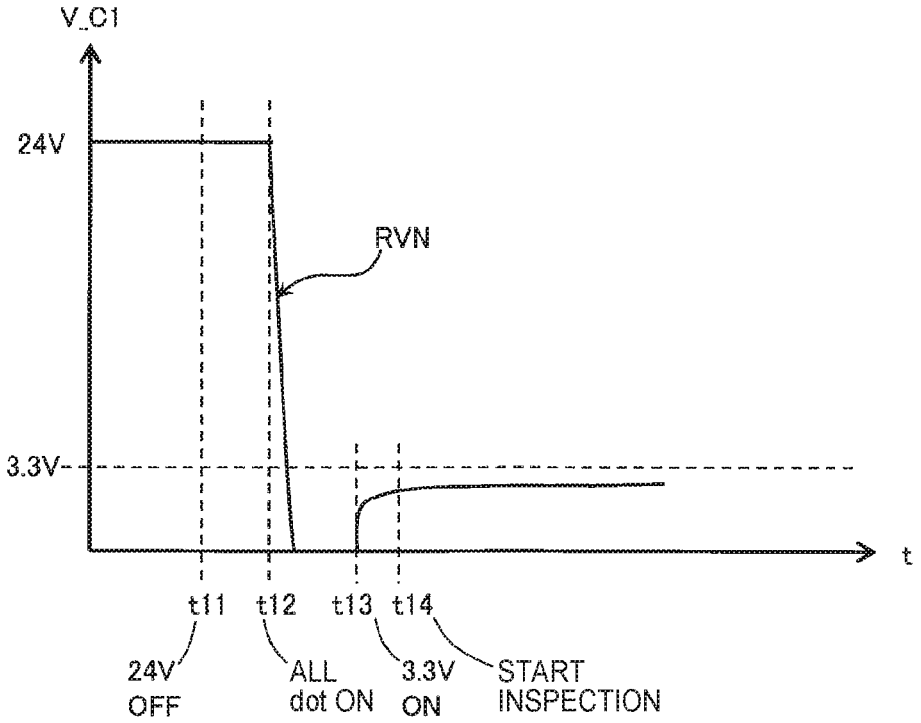
FIG. 16 illustrates the change in the voltage drop of the smoothing capacitor C1 when the invention is used.

FIG. 15 shows an example of voltage drop of the smoothing capacitor C1 when the invention is not used, and FIG. 16 shows an example of voltage drop of the smoothing capacitor C1 when the invention is used.

In the graphs in FIG. 15 and FIG. 16, the voltage (V) of the smoothing capacitor C1 is shown on the Y-axis, and time (t) is shown on the X-axis.

When the invention is not used, that is, when the residual charge of the smoothing capacitor C1 is not discharged, after a specific stabilization time has passed after the printing voltage is cut off at time t1 (24 VH OFF), the head element being inspected is energized (1 dot ON at time t2).

The residual charge of the smoothing capacitor C1 is then gradually discharged through the head element as indicated by curve RVO in FIG. 15, for example, and the voltage (V) of the smoothing capacitor C1 gradually drops. When the voltage drops to 3.3 V or below, a voltage that has no adverse effect on the inspection voltage application circuit (at time t3 in FIG. 15), inspecting (detecting deterioration of) the head elements (RH-1 to RH-n) starts.

When the invention is applied as shown in the example in FIG. 16, that is, in a printer 2 according to this embodiment, and the residual charge is discharged, when a specific stabilization time passes (step S62 in FIG. 13) after stopping the printing voltage at time t11 (24 VH OFF, step S61 in FIG. 13), all head elements are energized at time t12 (all dots ON at time t12, steps S731 and S732 in FIG. 14).

The residual charge in the smoothing capacitor C1 is then rapidly discharged through all of the head elements, and the voltage (V) of the smoothing capacitor C1 is discharged and drops as shown by curve RVN in FIG. 16, for example.

After then waiting a specific stabilization time (step S733 in FIG. 14), the inspection voltage is applied at time t13 (FIG. 16, 3.3V ON, step S64 in FIG. 13), and after waiting a specific stabilization time (step S65 in FIG. 13), inspecting (detecting deterioration of) the head elements (RH-1 to RH-n) starts (time t14 in FIG. 16).

By comparing the times when inspection starts in FIG. 15 and FIG. 16, it will be understood that the printer 2 according to this embodiment can start inspecting (detecting deterioration) the head elements (RH-1 to RH-n) a short time after printing ends.

The printer 2 according to this embodiment may also be configured with a voltage monitoring circuit as described below.

Figure 17:
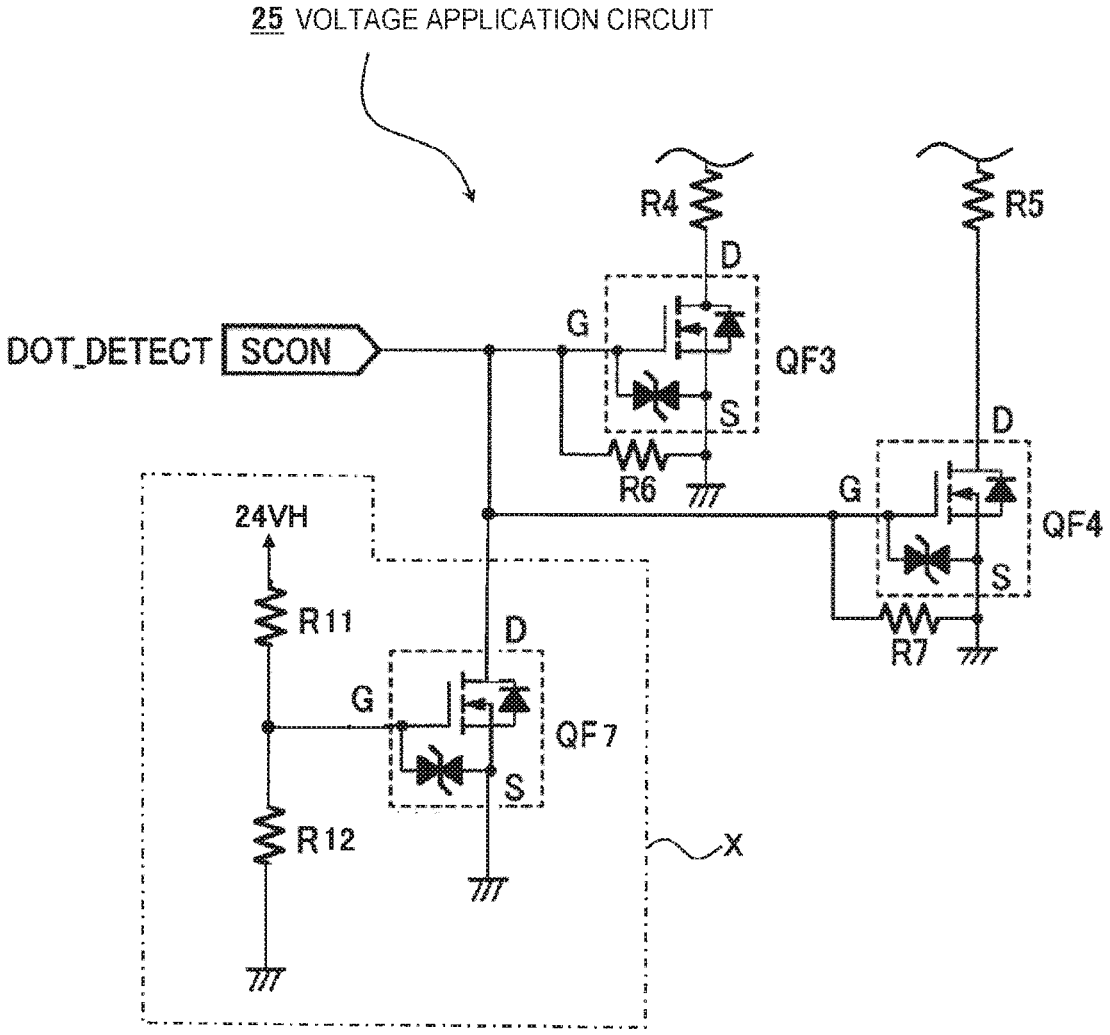
FIG. 17 shows an example of a voltage monitoring circuit.
Figure 18:
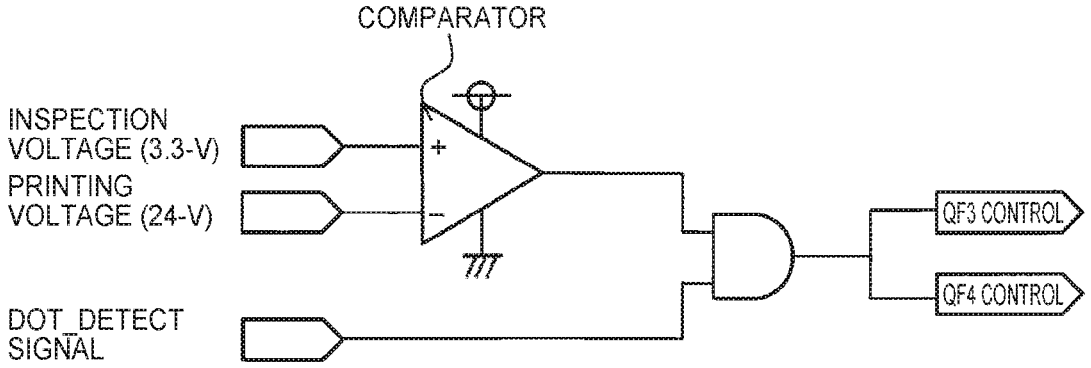
FIG. 18 shows another example of a voltage monitoring circuit.

FIG. 17 and FIG. 18 show examples of a voltage monitoring circuit. The circuit shown in FIG. 17 is the voltage monitoring circuit added to the circuit shown in FIG. 12, and shows only the portion around the voltage monitoring circuit. The part denoted by reference X in FIG. 17 is the voltage monitoring circuit.

In this example, the voltage monitoring circuit X comprises a FET configured identically to the control FET QF4 of the reverse current control FET QF2, and resistances R11 and R12. The voltage monitoring circuit functions to prevent the inspection voltage (3.3-V) from going ON when the printing voltage (24 VH) is ON, and prevents applying the printing voltage (24 VH) to the READ_HEAD port if the DOT_DETECT signal goes ON at the wrong time, such as due to external noise or a software runaway. FIG. 18 shows an example of a logic circuit as a voltage monitoring circuit. As shown in FIG. 18, the voltage monitoring circuit comprises a comparator and an AND gate, which are connected as shown in FIG. 18.

In the discharge process executed before head inspection (deterioration detection) in the embodiment described above, all head elements are energized, and energizing the head elements stops (step S734 in FIG. 14) after waiting a specific time (step S733 in FIG. 14), but energizing the head elements may end after confirming that the voltage of the smoothing capacitor C1 has gone below a specific threshold. In other words, the inspection voltage is applied after confirming that the voltage of the smoothing capacitor C1 has gone below a specific value.

As described above, a printer 2 according to the invention has a reverse current prevention control circuit (QF2) using a smoothing capacitor C1 and FET in the voltage application circuit 25, can print accurately and inspect the head elements, and can inspect (detect deterioration) the head elements in a short time by the above discharge process that energizes all head elements.

Furthermore, because the discharge process discharges for an appropriate time, the head elements can be easily inspected (deterioration detected) with no problem.

Furthermore, by providing a voltage monitoring circuit as described above, there is no danger of damaging inspection-side circuits.

The scope of the invention is not limited to the foregoing embodiment, and includes the invention described in the accompanying claims and equivalents thereof.

What is claimed is:

1. A printing device comprising:

a thermal head having multiple head elements;

a voltage application circuit configured to apply a printing voltage and an inspection voltage to the head elements;

a head controller configured to control the thermal head and the voltage application circuit; and data storage configured to store a conversion table that relationally stores a divided voltage and a resistance of the head elements; wherein the head controller, at a specific timing, applies the inspection voltage to the head elements by the voltage application circuit, measures the divided voltage of the head elements, converts the measured divided voltage to resistance based on the conversion table, acquires deterioration information based on the converted resistance, and stores the deterioration information in the data storage.

2. The printing device described in claim 1, wherein:
the data storage stores the initial value of the divided voltage or resistance of the head elements; and
the head controller acquires the deterioration information based on the initial value.

3. The printing device described in claim 1, wherein:
the deterioration information includes the rate of change in the resistance of the head elements.

4. The printing device described in claim 1, wherein:
the divided voltage is expressed by data of four bytes or less.

5. A control method of a printing device having a thermal head with multiple head elements,
a voltage application circuit configured to apply a printing voltage and an inspection voltage to the head elements, and
data storage configured to store a conversion table relationally storing a divided voltage and a resistance of the head elements,
the control method comprising:
at a specific timing, applying the inspection voltage to the head elements by the voltage application circuit,
measuring the divided voltage of the head elements,
converting the measured divided voltage to converted resistance based on the conversion table,
acquiring deterioration information based on the converted resistance, and
storing the deterioration information in the data storage.

6. A printing system comprising a control device and a printing device,
the printing device comprising a thermal head having multiple head elements;
a voltage application circuit configured to apply a printing voltage and an inspection voltage to the head elements;
data storage configured to store a conversion table that relationally stores a divided voltage and a resistance of the head elements; and
a head controller configured to, at a specific timing, apply the inspection voltage to the head elements by the voltage application circuit, measure the divided voltage of the head elements, convert the measured divided voltage to converted resistance based on the conversion table, acquire deterioration information based on the converted resistance, store the deterioration information in the data storage, and
send the divided voltage of the head elements and/or deterioration information to the control device.

7. The printing device described in claim 1, wherein:
the specific timing is when a state in which printing is not possible is detected.

8. The printing device described in claim 7, wherein:
the process of measuring the divided voltage of the head elements is applied to a specific number of head elements, the specific number being a number of head elements that can all be tested while printing is not possible.

9. The printing device described in claim 1, wherein:
the head controller determines a state of deterioration of the head elements using a plurality of threshold values previously set for the divided voltages.

10. The control method of described in claim 5, wherein:
the specific timing is when a state in which printing is not possible is detected.

11. The printing system of described in claim 6, wherein:
the specific timing is when a state in which printing is not possible is detected.

12. The printing system described in claim 6, wherein:
the control device sends a command to the printing device; and
the printing device receives the command and sends deterioration information to the control device.

13. A printing device comprising:
a printhead having multiple head elements;
a voltage application circuit configured to apply a printing voltage and an inspection voltage to the head elements; and
a head controller configured to control the printhead and the voltage application circuit; wherein
the voltage application circuit including a capacitor between a printing voltage control FET and the head elements, and a reverse current prevention FET between an inspection power supply and the head elements;
the head controller, when changing the printing voltage to the inspection voltage, energizes all head elements after stopping the printing voltage, and applies the inspection voltage after energizing the head elements.

14. The printing device described in claim 13, wherein:
the head controller applies the inspection voltage after waiting a specific time after energizing all the head elements.

15. The printing device described in claim 14, wherein:
the specific time is the time during which a residual charge of the capacitor is discharged.

16. A control method of a printing device having a printhead with multiple head elements, and a voltage application circuit configured to apply a printing voltage and an inspection voltage to the head elements,
the voltage application circuit including a capacitor between a printing voltage control FET and the head elements, and a reverse current prevention FET between an inspection power supply and the head elements,
the control method comprising
energizing all the head elements after stopping the printing voltage, and applying the inspection voltage after energizing the head elements, when changing the printing voltage to the inspection voltage.

17. The printing device described in claim 7, wherein the specific timing is when a print medium is cut after a printing process ends.

18. The control method described in claim 10, wherein the specific timing is when a print medium is cut after a printing process ends.

19. The printing system described in claim 11, wherein the specific timing is when a print medium is cut after a printing process ends.

* * * * *